US012329230B2

(12) United States Patent
Beauchamp et al.

(10) Patent No.: US 12,329,230 B2
(45) Date of Patent: Jun. 17, 2025

(54) SPORT HELMET

(71) Applicant: SPORT MASKA INC., Montreal (CA)

(72) Inventors: Pierre-Luc Beauchamp, Montréal (CA); Thierry Petelle, Montréal (CA); Philippe Martin, Chambly (CA); Brian Steenbrink, Pointe-Claire (CA); Simon-Pierre Germain, Granby (CA)

(73) Assignee: SPORT MASKA INC., St-Laurent (CA)

( * ) Notice: Subject to any disclaimer, the term of this patent is extended or adjusted under 35 U.S.C. 154(b) by 400 days.

(21) Appl. No.: 17/621,062

(22) PCT Filed: Jul. 3, 2020

(86) PCT No.: PCT/CA2020/050931
§ 371 (c)(1),
(2) Date: Dec. 20, 2021

(87) PCT Pub. No.: WO2021/000052
PCT Pub. Date: Jan. 7, 2021

(65) Prior Publication Data

US 2022/0330648 A1 Oct. 20, 2022

Related U.S. Application Data

(60) Provisional application No. 62/879,216, filed on Jul. 26, 2019, provisional application No. 62/872,955, (Continued)

(51) Int. Cl.
*A42B 3/32* (2006.01)
*A42B 3/06* (2006.01)

(52) U.S. Cl.
CPC ..... *A42B 3/324* (2013.01); *A42B 3/064* (2013.01)

(58) Field of Classification Search
CPC ..... A42B 3/324; A42B 3/064; A42B 3/01; A42B 3/12
See application file for complete search history.

(56) References Cited

U.S. PATENT DOCUMENTS 5,204,998 A * 4/1993 Liu ..... A42B 3/124 2/425
9,320,311 B2 * 4/2016 Szalkowski ..... A42B 3/12
(Continued)

FOREIGN PATENT DOCUMENTS

| | | |
|---|---|---|
| CA | 2864522 | 7/2013 |
| CA | 2949756 | 11/2015 |
| CA | 2969885 | 12/2017 |

*Primary Examiner* — Khoa D Huynh
*Assistant Examiner* — Erick I Lopez
(74) *Attorney, Agent, or Firm* — Norton Rose Fulbright Canada

(57) ABSTRACT

A protective sport helmet includes an outer shell, and an inner padding mounted within the outer shell for at least partially covering the wearer's head, the inner padding defining a base face oriented toward the wearer's head and at least one pedestal extending from the base face away from the outer shell, the pedestal defining a pedestal face facing the wearer's head. At least one tangential shock absorber has a first face at least partially covering the pedestal face and a second face opposed the first face and configured for contacting the wearer's head. The tangential shock absorber includes a shearable member that is deformable such that the first face is movable relative to the second face in a direction having a radial component relative to an axis normal to the pedestal face.

31 Claims, 25 Drawing Sheets

Related U.S. Application Data filed on Jul. 11, 2019, provisional application No. 62/870,475, filed on Jul. 3, 2019, provisional application No. 62/870,461, filed on Jul. 3, 2019.

(56) References Cited

U.S. PATENT DOCUMENTS

| | | | | |
|---|---|---|---|---|
| 10,660,390 | B2 * | 5/2020 | Ku | A42B 3/064 |
| 2002/0002730 | A1 * | 1/2002 | Dennis | B32B 25/08 2/414 |
| 2013/0086733 | A1 * | 4/2013 | Szalkowski | A42B 3/12 2/414 |
| 2017/0172242 | A1 * | 6/2017 | Leatt | A42B 3/064 |
| 2017/0265556 | A1 * | 9/2017 | Yang | A63B 71/10 |
| 2020/0022443 | A1 * | 1/2020 | Wetzel | A42B 3/121 |
| 2021/0401102 | A1 * | 12/2021 | Keevy | A42B 3/064 |

* cited by examiner

SPORT HELMET

CROSS-REFERENCE TO RELATED APPLICATIONS

This application claims priority from U.S. patent applications 62/870,461 filed on Jul. 3, 2019, 62/872,955 filed on Jul. 11, 2019, 62/870,475 filed on Jul. 3, 2019, and 62/879,216 filed on Jul. 26, 2019. The entire content of each of these prior applications is incorporated herein by reference.

TECHNICAL FIELD

This present disclosure relates to sport equipment, and more particularly to protective sport helmets.

BACKGROUND

Protective sport helmets, such as hockey helmets, are used to provide impact resistance to a head of a wearer. While existing sport helmets are generally suitable for their intended purpose, continuous improvement for such protective sport helmets is sought.

Impacts to which such helmets may be exposed include two principle forms: linear impact and rotational impact. Linear impact occurs when an impact force is applied to an outer shell of the helmet at an angle of about 90 degrees. Rotational impact occurs when the impact force is oriented at an angle different than 90 degrees with the outer shell. Rotational impacts may cause the wearer's head to rotate and are known to influence the occurrence of concussions.

The back portion of the wearer's head may also be particularly sensitive to impact. To that end, an inner padding of the helmet typically has an occipital region facing an occipital portion of the wearer's head. Improvements of the inner paddings of helmets, more specifically proximate the occipital region of the wearer's head, are always desired.

Moreover, the different padding portions of the helmet, for instance, the front padding, the rear padding, and the side paddings, may be subjected to different kinds of impacts and of varying magnitudes. There is a constant need of improvements in the padding portions of helmets, and in their methods of manufacture, to increase their impact bearing capabilities.

SUMMARY

There is therefore provided a sport helmet for receiving a head of a wearer, comprising: an outer shell; an inner padding mounted within the outer shell for covering at least partially the wearer's head, the inner padding defining a base face oriented toward the wearer's head and at least one pedestal extending from the base face away from the outer shell, the at least one pedestal defining a pedestal face facing the wearer's head; and at least one tangential shock absorber having a first face at least partially covering the pedestal face and a second face opposed the first face and configured for contacting the wearer's head, the at least one tangential shock absorber including a shearable member, the shearable member deformable such that the first face is movable relative to the second face in a direction having a radial component relative to an axis normal to the pedestal face.

The sport helmet as defined above and herein may also include one or more of the additional features, in whole or in part, and in any combination.

The at least one tangential shock absorber is a bladder and wherein the shearable member is at least one fluid.

The shearable member includes a first layer of a first fluid and a second layer of a second fluid, the first layer sandwiched between the at least one pedestal and the second layer, the first fluid having a viscosity different than that of the second fluid.

The at least one tangential shock absorber is secured to the at least one pedestal by a rivet, the rivet having a male member secured to one of the at least one pedestal and the at least one tangential shock absorber and a female member removably engageable by the male member and secured to the other of the at least one pedestals and the at least one tangential shock absorber.

The rivet is made of shock absorbing material.

The at least one pedestal includes a front pedestal located to face a front portion of the wearer's head, a rear pedestal located to face a rear portion of the wearer's head, left and right pedestals each facing a respective one of left and right sides of the wearer's head, and a top pedestal to face a top portion of the wearer's head.

The at least one tangential shock absorber includes front, rear, left, right, and top tangential shock absorbers each secured to a respective one of the front, rear, left right, and top pedestals.

A distance between the pedestal face and the base face taken along the axis normal to the pedestal face ranges from 0.5 to 5 mm.

An area of the pedestal face is less than that of the first face.

The at least one pedestal is made from expanded polypropylene foam, expanded polyethylene foam, vinyl nitrile foam and expanded polymeric foam.

A material of the at least one pedestal is different than a material of a remainder of the inner padding.

A material of the at least one pedestal corresponds to a material of a remainder base of the inner padding.

The at least one pedestal is monolithic with a remainder of the inner padding.

The inner padding is made of rubber, styrene-butadiene rubber, polyurethane elastomer, polyvinyl chloride foam, or polyurethane foam.

There is also provided, in accordance with another aspect, a sport helmet for receiving a head of a wearer, comprising: an outer shell; and an impact-mitigating system at least partially enclosed by the outer shell and defining a head interface for contacting the wearer's head, the impact-mitigating system including a rotational-impact-mitigation layer extending from the head interface toward the outer shell, a linear-impact-mitigation layer extending from the outer shell toward the head interface, and an intermediate layer between the rotational-impact-mitigation layer and the linear-impact-mitigation layer, the linear-impact-mitigation layer including an inner padding, the intermediate layer having at least one pedestal affixed relative to the inner padding, the rotational-impact-mitigation layer having at least one shearable member at least partially covering the at least one pedestal, the at least one shearable member spaced apart from the inner padding by the at least one pedestal, the at least one shearable member having a face defining a part of the head interface and being translatable relative to the pedestal in a direction being at least partially tangential to the head interface.

The sport helmet as defined above and herein may also include one or more of the additional features, in whole or in part, and in any combination.

The at least one shearable member is a bladder containing at least one fluid.

The at least one shearable member includes a first layer of a first fluid and a second layer of a second fluid, the first layer sandwiched between the at least one pedestal and the second layer, the first fluid having a viscosity different than that of the second fluid.

The at least one shearable member is secured to the at least one pedestal by a rivet, the rivet having a male member secured to one of the at least one pedestal and the at least one tangential shock absorber and a female member removably engageable by the male member and secured to the other of the at least one pedestals and the at least one tangential shock absorber.

The at least one pedestal includes a front pedestal located to face a front portion of the wearer's head, a rear pedestal located to face a rear portion of the wearer's head, left and right pedestals each facing a respective one of left and right sides of the wearer's head, and a top pedestal to face a top portion of the wearer's head.

The at least one shearable member includes front, rear, left, right, and top shearable members each secured to a respective one of the front, rear, left right, and top pedestals.

A distance between the linear-impact-mitigation layer and the rotational-impact-mitigation layer ranges from 0.5 to 5 mm.

There is further provided, in accordance with another aspect, a sport helmet for receiving a head of a wearer, comprising: an outer shell; an inner padding in the outer shell, the inner padding having a rear padding portion for covering at least part of a rear region of the wearer's head, the rear padding portion comprising left, central and right walls defining a rear space for at least partially overlapping an occipital region of the wearer's head; an occipital inner pad being at least partially located in the rear space for facing the occipital region of the wearer's head; and at least one biasing portion between the outer shell and the occipital inner pad, the occipital inner bad movable between a first position and a second position, wherein in the first position the occipital inner pad is biased inwardly by the at least one biasing portion, and wherein in the second position the occipital inner pad is moved towards the outer shell upon the sport helmet covering the wearer's head, the at least one biasing portion biasing the occipital inner pad against the wearer's head such that the occipital inner pad contacts the wearer's head while maintaining pressure against the occipital region of the wearer's head.

The sport helmet as defined above and herein may also include one or more of the additional features, in whole or in part, and in any combination.

The at least one biasing portion is made of a resilient material such that the occipital inner pad returns to the first position when the occipital inner pad is free of pressure applied thereto and such that the at least one biasing portion is compressed and exerts pressure on the occipital inner pad in the second position.

The at least one biasing portion defines an end portion for facing the outer shell, the end portion in abutment against the outer shell in both of the first and second positions.

The at least one biasing portion includes a left biasing portion located on a left side of the helmet and a right biasing portion located on a right side of the helmet.

The at least one biasing portion comprises a base portion located adjacent to the occipital inner pad, an end portion spaced apart from the base portion, the at least one biasing portions tapering from the base portion to the end portion.

The at least one biasing portion comprises a base portion located adjacent to the occipital inner pad and away from an end portion and a plurality of sections superposed onto each other between the base portion and the end portion, the plurality of sections including a first section located adjacent the base portion and a second section located adjacent the end portion, the first section having a first cross-sectional area and the second section having a second cross-sectional area smaller than the first cross-section area.

The plurality of sections includes at least one intermediate section located between the first section and the second section, each intermediate section having a third cross-sectional area smaller than the first cross-section area and greater than the second cross-sectional area.

The occipital inner pad has a first part downwardly from the central wall and a second part extending transversally from the first part, the first part comprising an upper end hingedly connected to the central wall of the rear padding portion or to the inner wall of the rear shell portion and a bottom end connected to the second part.

The upper end of the first part of the occipital inner pad is monothically connected to the central wall of the rear padding portion.

There is further still provided, in accordance with another aspect, a method of making an inner pad for a sport helmet, the method comprising: obtaining a core having a three-dimensional shape for at least partially conforming with an external portion of a wearer's head, the core being made of a first material and defining an edge portion; and overmolding a second material over the edge portion of the core, the second material being different than the first material.

The method as defined above and herein may also include one or more of the additional steps and/or features, in whole or in part, and in any combination.

The second material is softer than the first material.

The first material has a first hardness and the second material has a second hardness, the second hardness being lower than the first hardness.

The first material is a polymeric foam and wherein the second material is thermoplastic polyurethane (TPU).

The polymeric foam is selected from a group comprising as expanded polypropylene (EPP) foam, expanded polyethylene (EPE) foam, vinyl nitrile (VN) foam, polyurethane foam, and expanded polymeric microspheres.

The first material has a first hardness of about 80 to 85 Shore 00 and the second material has a second hardness of about 30 to 45 Shore 00.

There is also provided, in accordance with yet another aspect, a sport helmet for receiving a head of a wearer, the wearer's head having a front region, a top region, left and right side regions and a rear region, the helmet comprising an outer shell and an inner padding mounted within the outer shell for covering at least partially the wearer's head, the inner padding comprising a front portion for covering at least partially the front and top regions of the wearer's head and a rear portion for covering at least partially the rear region of the wearer's head, the front portion being at least partially made of a first material and the rear portion being at least partially made of a second material, the first material being different than the second material.

The sport helmet as defined above and herein may also include one or more of the additional features, in whole or in part, and in any combination.

The first material is at least partially made of ethylene vinyl acetate (EVA) foam, a vinyl nitrile (VN) foam, a polyvinyl chloride (PVC) foam, neoprene, silicone, Lycra, spandex or rubber and wherein the second material is at least partially made of thermoplastic polyurethane, polyethylene, vinyl, Teflon, polystyrene or polypropylene.

The first material has a first coefficient of friction and wherein the second material has a second coefficient of friction, the first coefficient of friction being higher than the second coefficient of friction.

The first material provides frictional engagement with the wearer's head and wherein the second material provides sliding engagement with the wearer's head.

The first material at least partially defines a first inner surface that provides frictional engagement with the wearer's head and wherein the second material at least partially defines a second inner surface that provides sliding engagement with the wearer's head.

The following additional and/or alternate aspects are also provided in accordance with the present disclosure.

In a first aspect, there is provided a sport helmet for receiving a head of a wearer, the wearer's head having a front region, a top region, left and right side regions and a rear region, the helmet having a longitudinal axis, a transversal axis, a vertical axis and left and right sides, the helmet comprising an outer shell and an inner padding mounted within the outer shell for covering at least partially the wearer's head, the inner padding comprising a base defining a base surface for facing the wearer's head and first and second sections extending inwardly from the base and defining first and second surfaces for facing the wearer's head and being at first and second distances from the base surface, wherein, in use, upon an impact against the outer shell, the base surface does not contact the wearer's head at initial impact dispersion into the helmet and the first and second sections are first activated to absorb and reduce rotational acceleration of the wearer's head.

Still in accordance with the first aspect, the first and second surfaces of the first and second sections may be located at first and second distances from the base surface, the first and second distances being between 0.5 mm and 5 mm.

Still in accordance with the first aspect, the first and second sections may be located in the longitudinal axis of the helmet, the first section being located to be positioned over the front and top regions of the wearer's head and the second section being located to be positioned over the top region of the wearer's head.

Still in accordance with the first aspect, the sport helmet may comprise a third section extending inwardly from the base and defining a third surface for facing the wearer's head and being at a third distance from the base surface, wherein, in use, upon an impact against the outer shell, the base surface does not contact the wearer's head at the initial impact dispersion and the first, second and third sections are first activated to absorb and reduce rotational acceleration of the wearer's head.

Still in accordance with the first aspect, the third surface of the third section may be located at a third distance from the base surface, the third distance being between 0.5 mm and 5 mm.

Still in accordance with the first aspect, the third section may be located in the longitudinal axis of the helmet, the third section being located to be positioned over the rear region of the wearer's head.

Still in accordance with the first aspect, in use, the first, second and third sections may absorb rotational acceleration by compression and/or shearing movement while maintaining a sufficient distance between the base surface and the wearer's head to allow rotation of the helmet around the wearer's head for reducing rotational acceleration.

Still in accordance with the first aspect, the helmet may comprise a fourth section extending inwardly from the base and defining a fourth surface for facing the wearer's head and being at a fourth distance from the base surface, wherein, in use, upon an impact against the outer shell, the base surface does not contact the wearer's head at the initial impact dispersion and the first, second, third and fourth sections are first activated to absorb and reduce rotational acceleration of the wearer's head.

Still in accordance with the first aspect, the fourth surface of the fourth section may be located at a fourth distance from the base surface, the fourth distance being between 0.5 mm and 5 mm.

Still in accordance with the first aspect, the fourth section may be located in the transversal axis of the helmet, the fourth section being located to be positioned over the left side region of the wearer's head.

Still in accordance with the first aspect, the helmet may comprise a fifth section extending inwardly from the base and defining a fifth surface for facing the wearer's head and being at a fifth distance from the base surface, wherein, in use, upon an impact against the outer shell, the base surface does not contact the wearer's head at the initial impact dispersion and the first, second, third, fourth and fifth sections are first activated to absorb and reduce rotational acceleration of the wearer's head.

Still in accordance with the first aspect, the fifth surface of the fifth section may be located at a fifth distance from the base surface, the fifth distance being between 0.5 mm and 5 mm.

Still in accordance with the first aspect, the fifth section may be located in the transversal axis of the helmet, the fifth section being located to be positioned over the right side region of the wearer's head.

Still in accordance with the first aspect, the first, second and third sections may be made of a first material, wherein the base is made of a second material, wherein the first and second material may be identical.

Still in accordance with the first aspect, the first and second materials may be made from a material selected in the group consisting of expanded polypropylene foam, expanded polyethylene foam, vinyl nitrile foam and expanded polymeric foam.

Still in accordance with the first aspect, the first, second and third sections may be made of a first material, wherein the base is made of a second material, wherein the second material may be different than the first material.

Still in accordance with the first aspect, the second material may be made from a material selected in the group consisting of expanded polypropylene foam, expanded polyethylene foam, vinyl nitrile foam and expanded polymeric foam and the first material may be made from a material selected in the group consisting of rubber, styrene-butadiene rubber, polyurethane elastomer, polyvinyl chloride foam or polyurethane foam.

Still in accordance with the first aspect, in use, when the wearer's head contacts the base surface, the base may be then activated to absorb and reduce linear acceleration of the wearer's head.

In accordance with a second aspect, there is provided a sport helmet for receiving a head of a wearer, the wearer's head having a front region, a top region, left and right side regions and a rear region, the helmet having a longitudinal axis, a transversal axis, a vertical axis and left and right sides, the helmet comprising: an outer shell; an inner padding mounted within the outer shell for covering at least partially the wearer's head, the inner padding comprising a base defining a base surface and first and second sections extending inwardly from the base and defining first and second surfaces being at first and second distances from the base surface; and first and second bladders for facing the wearer's head and being mounted to the first and second surfaces of the first and second sections; wherein, in use, upon an impact against the outer shell, the base surface does not contact the wearer's head at initial impact dispersion into the helmet and the first and second bladders are first activated to absorb and reduce rotational acceleration of the wearer's head.

Still in accordance with the second aspect, in use, upon an impact against the outer shell and once the first and second bladders may be activated to absorb and reduce rotational acceleration of the wearer's head, the first and second section may be also activated to absorb and reduce rotational acceleration of the wearer's head.

Still in accordance with the second aspect, the first and second surfaces of the first and second sections may be located at first and second distances from the base surface, the first and second distances being between 0.5 mm and 5 mm, and wherein the first and second bladders may be adapted to contact the wearer's head.

Still in accordance with the second aspect, the first and second sections and first and second bladders may be located in the longitudinal axis of the helmet, the first section and bladder being located to be positioned over the front and top regions of the wearer's head and the second section and bladder being located to be positioned over the top region of the wearer's head.

Still in accordance with the second aspect, the helmet may comprise a third section extending inwardly from the base and defining a third surface being at a third distance from the base surface and a third bladder for facing the wearer's head and being mounted to the third surface of the third section, wherein, in use, upon an impact against the outer shell, the base surface does not contact the wearer's head at the initial impact dispersion and the first, second and third bladders are first activated to absorb and reduce rotational acceleration of the wearer's head.

Still in accordance with the second aspect, in use, upon an impact against the outer shell and once the first, second and third bladders may be activated to absorb and reduce rotational acceleration of the wearer's head, the first, second and third sections may be also activated to absorb and reduce rotational acceleration of the wearer's head.

Still in accordance with the second aspect, the third surface of the third section may be located at a third distance from the base surface, the third distance being between 0.5 mm and 5 mm, and wherein the third bladder may be adapted to contact the wearer's head.

Still in accordance with the second aspect, the third section and third bladder may be located in the longitudinal axis of the helmet, the third section and third bladder being located to be positioned over the rear region of the wearer's head.

Still in accordance with the second aspect, in use, the first, second and third bladders may absorb rotational acceleration by compression and/or shearing movement while maintaining a sufficient distance between the base surface and the wearer's head to allow rotation of the helmet around the wearer's head for reducing rotational acceleration.

Still in accordance with the second aspect, the helmet may comprise a fourth section extending inwardly from the base and defining a fourth surface being at a fourth distance from the base surface and a fourth bladder for facing the wearer's head and being mounted to the fourth surface of the fourth section, wherein, in use, upon an impact against the outer shell, the base surface does not contact the wearer's head at the initial impact dispersion and the first, second, third and fourth bladders are first activated to absorb and reduce rotational acceleration of the wearer's head.

Still in accordance with the second aspect, the fourth surface of the fourth section may be located at a fourth distance from the base surface, the fourth distance being between 0.5 mm and 5 mm, and wherein the fourth bladder may be adapted to contact the wearer's head.

Still in accordance with the second aspect, the fourth section and fourth bladder may be located in the transversal axis of the helmet, the fourth section and fourth bladder being located to be positioned over the left side region of the wearer's head.

Still in accordance with the second aspect, the helmet may comprise a fifth section extending inwardly from the base and defining a fifth surface being at a fifth distance from the base surface and a fifth bladder for facing the wearer's head and being mounted to the fifth surface of the fifth section, wherein, in use, upon an impact against the outer shell, the base surface does not contact the wearer's head at the initial impact dispersion and the first, second, third, fourth and fifth bladders are first activated to absorb and reduce rotational acceleration of the wearer's head.

Still in accordance with the second aspect, the fifth surface of the fifth section may be located at a fifth distance from the base surface, the fifth distance being between 0.5 mm and 5 mm, and wherein the fifth bladder may be adapted to contact the wearer's head.

Still in accordance with the second aspect, the fifth section and fifth bladder may be located in the transversal axis of the helmet, the fifth section and fifth bladder being located to be positioned over the right side region of the wearer's head.

Still in accordance with the second aspect, the first, second and third sections may be made of a first material, wherein the base may be made of a second material, wherein the first and second material may be identical.

Still in accordance with the second aspect, the first and second materials may be made from a material selected in the group consisting of expanded polypropylene foam, expanded polyethylene foam, vinyl nitrile foam and expanded polymeric foam.

Still in accordance with the second aspect, the first, second and third sections may be made of a first material, wherein the base may be made of a second material, wherein the second material may be different than the first material.

Still in accordance with the second aspect, the second material may be made from a material selected in the group consisting of expanded polypropylene foam, expanded polyethylene foam, vinyl nitrile foam and expanded polymeric foam and the first material may be made from a material selected in the group consisting of rubber, styrene-butadiene rubber, polyurethane elastomer, polyvinyl chloride foam or polyurethane foam.

Still in accordance with the second aspect, the first, second and third bladders may comprise flexible containers, bags, pouches or envelopes containing a liquid, a gas or a gel.

Still in accordance with the second aspect, in use, when the wearer's head contacts the base surface, the base may be then activated to absorb and reduce linear acceleration of the wearer's head.

In a third aspect, there is provided a sport helmet for receiving a head of a wearer, the wearer's head having a top region, left and right side regions, a rear region and an occipital region, the helmet having a longitudinal axis, a transversal axis, a vertical axis and left and right sides, the helmet comprising: an outer shell comprising a front shell portion and a rear shell portion, the rear shell portion comprising an outer wall and an inner wall; an inner padding in the outer shell, the inner padding comprising a front padding portion for covering at least part of the top region and left and right side regions of the wearer's head and a rear padding portion for covering at least part of the rear region and the left and right side regions of the wearer's head, the rear padding portion comprising left, central and right walls defining a rear space for at least partially overlapping the occipital region of the wearer's head; an occipital inner pad being at least partially located in the rear space for facing the occipital region of the wearer's head; and a biasing portion between the inner wall of the rear shell portion and the occipital inner pad; wherein, in use, the occipital inner pad is movable between a first position, wherein the occipital inner pad is biased inwardly by the biasing portion, and a second position, wherein the occipital inner pad is moved towards the inner wall of the rear shell portion when the wearer puts on the helmet and wherein the biasing portion exerts pressure on the occipital inner pad such that the occipital inner pad contacts the occipital region of the wearer's head while maintaining pressure against the occipital region of the wearer's head; and wherein the biasing portion is made of a resilient material such that the occipital inner pad returns to the first position when pressure is no longer applied on the occipital inner pad and such that the biasing portion is compressed and exerts pressure on the occipital inner pad in the second position.

Still in accordance with the third aspect, the biasing portion may define an end portion for facing the inner wall of the rear shell portion, wherein in the first position, the end portion abuts the inner wall of the rear shell portion for biasing the occipital inner pad inwardly, and wherein in the second position, the end portion abuts the inner wall of the rear shell portion while the biasing portion is compressed and exerts pressure on the occipital inner pad.

Still in accordance with the third aspect, the biasing portion may be a left biasing portion located on the left side of the helmet and the end portion is a left end portion, the helmet comprising a right biasing portion located on the right side of the helmet and between the inner wall of the rear shell portion and the occipital inner pad helmet, the right biasing portion being made of a resilient material such that the occipital inner pad returns to the first position when pressure is no longer applied on the occipital inner pad.

Still in accordance with the third aspect, the right biasing portion may define a right end portion for facing the inner wall of the rear shell portion, wherein in the first position, the right end portion abuts the inner wall of the rear shell portion for biasing the occipital inner pad inwardly, and wherein in the second position, the right end portion abuts the inner wall of the rear shell portion while the biasing portion is compressed and exerts pressure on the occipital inner pad.

Still in accordance with the third aspect, the left and right biasing portions may extend along an axis generally parallel to the transversal axis.

Still in accordance with the third aspect, the left and right biasing portions may comprise respective left and right base portions located adjacent to the occipital inner pad and away from the left and right end portions, the left and right members being tapering from the left and right base portions to the left and right end portions.

Still in accordance with the third aspect, the biasing portion may comprise a base portion located adjacent to the occipital inner pad and away from the end portion and a plurality of sections superposed onto each other between the base portion and the end portion, the plurality of sections including a first section located adjacent the base portion and a second section located adjacent the end portion, the first section having a first cross-sectional area and the second section having a second cross-sectional area smaller than the first cross-section area.

Still in accordance with the third aspect, the plurality of sections may include at least one intermediate section located between the first section and the second section, each intermediate section having a third cross-sectional area smaller than the first cross-section area and greater than the second cross-sectional area.

Still in accordance with the third aspect, the at least one intermediate section may include a single intermediate section.

Still in accordance with the third aspect, the first section may have a first thickness and the second section has a second thickness smaller than the first thickness.

Still in accordance with the third aspect, the occipital inner pad may have a first part extending along an axis generally parallel to the vertical axis and a second part extending along an axis generally parallel to the transversal axis, the first part comprising an upper end hingedly connected to the central wall of the rear padding portion or to the inner wall of the rear shell portion and a bottom end connected to the second part.

Still in accordance with the third aspect, the upper end of the first part of the occipital inner pad may be integrally connected to the central wall of the rear padding portion.

Still in accordance with the third aspect, the front shell and the rear shell portions may be separate front and rear shells, the front and rear padding portions are separate front and rear inner pads mounted in the front and rear shells, the front and rear shells being movable relative to one another such that the helmet is an adjustable helmet.

In accordance with a fourth aspect, there is provided a sport helmet for receiving a head of a wearer, the wearer's head having a top region, left and right side regions, a rear region and an occipital region, the helmet having a longitudinal axis, a transversal axis, a vertical axis and left and right sides, the helmet comprising: an outer shell comprising a front shell portion and a rear shell portion, the rear shell portion comprising an outer wall and an inner wall; an inner padding in the outer shell, the inner padding comprising a front padding portion for covering at least part of the top region and left and right side regions of the wearer's head and a rear padding portion for covering at least part of the rear region and the left and right side regions of the wearer's head, the rear padding portion comprising left, central and right walls defining a rear space for at least partially overlapping the occipital region of the wearer's head; an occipital inner pad being at least partially located in the rear space for facing the occipital region of the wearer's head; and a biasing portion between the inner wall of the rear shell portion and the occipital inner pad; wherein, in use, the occipital inner pad is movable between a first position, wherein the occipital inner pad is biased inwardly by the biasing portion, and a second position, wherein the occipital inner pad is moved towards the inner wall of the rear shell portion when the wearer puts on the helmet and wherein the biasing portion exerts pressure on the occipital inner pad such that the occipital inner pad contacts the occipital region of the wearer's head while maintaining pressure against the occipital region of the wearer's head; wherein the biasing portion is made of a resilient material such that the occipital inner pad returns to the first position when pressure is no longer applied on the occipital inner pad and such that the biasing portion is compressed and exerts pressure on the occipital inner pad in the second position; and wherein the biasing portion defines an end portion for facing the inner wall of the rear shell portion, wherein in the first position, the end portion abuts the inner wall of the rear shell portion for biasing the occipital inner pad inwardly, and wherein in the second position, the end portion abuts the inner wall of the rear shell portion while the biasing portion is compressed and exerts pressure on the occipital inner pad.

Still in accordance with the fourth aspect, the biasing portion may be a left biasing portion located on the left side of the helmet and the end portion is a left end portion, the helmet comprising a right biasing portion located on the right side of the helmet and between the inner wall of the rear shell portion and the occipital inner pad helmet, the right biasing portion being made of a resilient material such that the occipital inner pad returns to the first position when pressure is no longer applied on the occipital inner pad.

Still in accordance with the fourth aspect, the right biasing portion may define a right end portion for facing the inner wall of the rear shell portion, wherein in the first position, the right end portion abuts the inner wall of the rear shell portion for biasing the occipital inner pad inwardly, and wherein in the second position, the right end portion abuts the inner wall of the rear shell portion while the biasing portion is compressed and exerts pressure on the occipital inner pad.

Still in accordance with the fourth aspect, the occipital inner pad may have a first part extending along an axis generally parallel to the vertical axis and a second part extending along an axis generally parallel to the transversal axis, the first part comprising an upper end hingedly connected to the central wall of the rear padding portion or to the inner wall of the rear shell portion and a bottom end connected to the second part.

Still in accordance with the fourth aspect, the biasing portion may comprise a base portion located adjacent to the occipital inner pad and away from the end portion and a plurality of sections superposed onto each other between the base portion and the end portion, the plurality of sections including a first section located adjacent the base portion and a second section located adjacent the end portion, the first section having a first cross-sectional area and the second section having a second cross-sectional area smaller than the first cross-section area.

Still in accordance with the fourth aspect, the plurality of sections may include at least one intermediate section located between the first section and the second section, each intermediate section having a third cross-sectional area smaller than the first cross-section area and greater than the second cross-sectional area.

Still in accordance with the fourth aspect, the front shell and the rear shell portions may be separate front and rear shells, the front and rear padding portions are separate front and rear inner pads mounted in the front and rear shells, the front and rear shells being movable relative to one another such that the helmet is an adjustable helmet.

In accordance with a fifth aspect, there is provided sport helmet for receiving a head of a wearer, the wearer's head having a top region, left and right side regions, a rear region and an occipital region, the helmet having a longitudinal axis, a transversal axis, a vertical axis and left and right sides, the helmet comprising: an outer shell comprising a front shell portion and a rear shell portion, the rear shell portion comprising an outer wall and an inner wall; an inner padding in the outer shell, the inner padding comprising a front padding portion for covering at least part of the top region and left and right side regions of the wearer's head and a rear padding portion for covering at least part of the rear region and the left and right side regions of the wearer's head, the rear padding portion comprising left, central and right walls defining a rear space for at least partially overlapping the occipital region of the wearer's head; an occipital inner pad being at least partially located in the rear space for facing the occipital region of the wearer's head, the occipital inner pad being hingedly connected to the central wall of the rear padding portion or to the inner wall of the rear shell portion, the occipital inner pad comprising a first part extending along an axis generally parallel to the vertical axis and a second part extending along an axis generally parallel to the transversal axis, wherein the second part has a front side for contacting the occipital region of the wearer's head and a rear side for facing the inner wall of the rear shell and wherein a gap is defined between the rear side and the inner wall; and a biasing portion that is between the inner wall of the rear shell portion and the occipital inner pad and that is in the gap; wherein, is use, the occipital inner pad is movable between first and second positions, wherein in the first position, the occipital inner pad is biased inwardly by the biasing portion, and when the wearer puts on the helmet, the occipital inner pad moves towards the second position wherein the biasing portion exerts pressure on the occipital inner pad such that the front side of the second part of the inner occipital inner pad contacts the occipital region of the wearer's head while maintaining pressure against the occipital regions of the wearer's head.

Still in accordance with the fifth aspect, the biasing portion may be made of a resilient material such that the occipital inner pad returns to the first position when pressure is no longer applied on the occipital inner pad and such that the biasing portion is compressed and exerts pressure on the occipital inner pad in the second position.

Still in accordance with the fifth aspect, the biasing portion may be mounted on the occipital inner pad and extends rearwardly from the occipital inner pad and toward the inner wall of the rear shell portion.

Still in accordance with the fifth aspect, the biasing portion may define an end portion for facing the inner wall of the rear shell portion, wherein in the first position, the end portion abuts the inner wall of the rear shell portion for biasing the occipital inner pad inwardly, and wherein in the second position, the end portion abuts the inner wall of the rear shell portion while the biasing portion is compressed and exerts pressure on the occipital inner pad.

Still in accordance with the fifth aspect, the biasing portion may be a left biasing portion located on the left side of the helmet and the end portion is a left end portion, the helmet comprising a right biasing portion located on the right side of the helmet and between the inner wall of the rear shell portion and the occipital inner pad helmet, the right biasing portion being made of a resilient material such that the occipital inner pad returns to the first position when pressure is no longer applied on the occipital inner pad and such that the biasing portion is compressed and exerts pressure on the occipital inner pad in the second position.

Still in accordance with the fifth aspect, the right biasing portion may define a right end portion for facing the inner wall of the rear shell portion, wherein in the first position, the right end portion abuts the inner wall of the rear shell portion for biasing the occipital inner pad inwardly, and wherein in the second position, the right end portion abuts the inner wall of the rear shell portion while the biasing portion is compressed and exerts pressure on the occipital inner pad.

Still in accordance with the fifth aspect, the biasing portion may comprise a base portion located adjacent to the occipital inner pad and away from the end portion and a plurality of sections superposed onto each other between the base portion and the end portion, the plurality of sections including a first section located adjacent the base portion and a second section located adjacent the end portion, the first section having a first cross-sectional area and the second section having a second cross-sectional area smaller than the first cross-section area.

Still in accordance with the fifth aspect, the plurality of sections may include at least one intermediate section located between the first section and the second section, each intermediate section having a third cross-sectional area smaller than the first cross-section area and greater than the second cross-sectional area.

Still in accordance with the fifth aspect, the front shell and the rear shell portions may be separate front and rear shells, the front and rear padding portions are separate front and rear inner pads mounted in the front and rear shells, the front and rear shells being movable relative to one another such that the helmet is an adjustable helmet.

In accordance with a sixth aspect, there is provided a sport helmet for receiving a head of a wearer, the wearer's head having a top region, left and right side regions, a rear region and an occipital region, the helmet having a longitudinal axis, a transversal axis, a vertical axis and left and right sides, the helmet comprising: an outer shell comprising a front shell portion and a rear shell portion, the rear shell portion comprising an outer wall and an inner wall; an inner padding in the outer shell, the inner padding comprising a front padding portion for covering at least part of the top region and left and right side regions of the wearer's head and a rear padding portion for covering at least part of the rear region and the left and right side regions of the wearer's head, the rear padding portion comprising left, central and right walls defining a rear space for at least partially overlapping the occipital region of the wearer's head; an occipital inner pad being at least partially located in the rear space for facing the occipital region of the wearer's head, the occipital inner pad being hingedly connected to the central wall of the rear padding portion or to the inner wall of the rear shell portion, the occipital inner pad comprising a first part extending along an axis generally parallel to the vertical axis and a second part extending along an axis generally parallel to the transversal axis, wherein the second part has a front side for contacting the occipital region of the wearer's head and a rear side for facing the inner wall of the rear shell and wherein a gap is defined between the rear side and the inner wall; wherein the occipital inner pad comprises a biasing portion mounted on the occipital inner pad and extending rearwardly from the occipital inner pad such that the biasing portion occupies the gap; wherein, in use, the occipital inner pad is movable between first and second positions, wherein in the first position, the occipital inner pad is biased inwardly by the biasing portion, and when the wearer puts on the helmet, the occipital inner pad moves towards the second position wherein the biasing portion exerts pressure on the occipital inner pad such that the front side of the second part of the inner occipital inner pad contacts the occipital region of the wearer's head while maintaining pressure against the occipital regions of the wearer's head; and wherein the biasing portion is made of a resilient material such that the occipital inner pad returns to the first position when pressure is no longer applied on the occipital inner pad and such that the biasing portion is compressed and exerts pressure on the occipital inner pad in the second position.

Still in accordance with the sixth aspect, the biasing portion may be a left biasing portion located on the left side of the helmet and the end portion is a left end portion, the helmet comprising a right biasing portion located on the right side of the helmet and between the inner wall of the rear shell portion and the occipital inner pad helmet, the right biasing portion being made of a resilient material such that the occipital inner pad returns to the first position when pressure is no longer applied on the occipital inner pad and such that the biasing portion is compressed and exerts pressure on the occipital inner pad in the second position.

In accordance with a seventh aspect, there is provided a method of making an inner pad for a sport helmet, the method comprising: providing a core having a three-dimensional shape for at least partially conforming with an external portion of a wearer's head, the core being made of a first material and defining an edge portion; and overmolding a second material over the edge portion of the core, the second material being different than the first material.

Still in accordance with the seventh aspect, the second material may be softer than the first material.

Still in accordance with the seventh aspect, the first material may have a first hardness and the second material has a second hardness, the second hardness being lower than the first hardness.

Still in accordance with the seventh aspect, the first material may be a polymeric foam such as expanded polypropylene (EPP) foam, expanded polyethylene (EPE) foam, vinyl nitrile (VN) foam, polyurethane foam, or expanded polymeric microspheres and wherein the second material is thermoplastic polyurethane (TPU).

Still in accordance with the seventh aspect, the first material may have a first hardness of about 80 to 85 Shore 00 and the second material has a second hardness of about 30 to 45 Shore 00.

In accordance with an eighth aspect, there is provided a sport helmet for receiving a head of a wearer, the wearer's head having a front region, a top region, left and right side regions and a rear region, the helmet comprising an outer shell and an inner padding mounted within the outer shell for covering at least partially the wearer's head, the inner padding comprising a front portion for covering at least partially the front and top regions of the wearer's head and a rear portion for covering at least partially the rear region of the wearer's head, the front portion being at least partially made of a first material and the rear portion being at least partially made of a second material, the first material being different than the second material.

Still in accordance with the eighth aspect, the first material may be at least partially made of ethylene vinyl acetate (EVA) foam, a vinyl nitrile (VN) foam, a polyvinyl chloride (PVC) foam, neoprene, silicone, Lycra, spandex or caoutchouc and wherein the second material is at least partially made of thermoplastic polyurethane, polyethylene, vinyl, Teflon, polystyrene or polypropylene.

Still in accordance with the eighth aspect, the first material may have a first coefficient of friction and wherein the second material has a second coefficient of friction, the first coefficient of friction being higher than the second coefficient of friction.

Still in accordance with the eighth aspect, the first material may provide frictional engagement with the wearer's head and wherein the second material provides sliding engagement with the wearer's head.

Still in accordance with the eighth aspect, the first material may at least partially define a first inner surface that provides frictional engagement with the wearer's head and wherein the second material at least partially defines a second inner surface that provides sliding engagement with the wearer's head.

In accordance with a ninth aspect, there is provided a sport helmet for receiving a head of a wearer, the wearer's head having a front region, a top region, left and right side regions and a rear region, the helmet comprising an outer shell, an inner padding mounted within the outer shell for covering at least partially the wearer's head, and an inner liner mounted within the inner padding for covering at least partially the wearer's head, the inner liner comprising a front portion for covering at least partially the front and top regions of the wearer's head and a rear portion for covering at least partially the rear region of the wearer's head, the front portion being at least partially made of a first material and the rear portion being at least partially made of a second material, the first material being different than the second material.

Still in accordance with the ninth aspect, the first material may be at least partially made of ethylene vinyl acetate (EVA) foam, a vinyl nitrile (VN) foam, a polyvinyl chloride (PVC) foam, neoprene, silicone, Lycra, spandex or caoutchouc and wherein the second material is at least partially made of thermoplastic polyurethane, polyethylene, vinyl, Teflon, polystyrene or polypropylene.

Still in accordance with the ninth aspect, the first material may have a first coefficient of friction and wherein the second material has a second coefficient of friction, the first coefficient of friction being higher than the second coefficient of friction.

Still in accordance with the ninth aspect, the first material may provide frictional engagement with the wearer's head and wherein the second material provides sliding engagement with the wearer's head.

Still in accordance with the ninth aspect, the first material may at least partially define a first inner surface that provides frictional engagement with the wearer's head and wherein the second material at least partially defines a second inner surface that provides sliding engagement with the wearer's head.

DETAILED DESCRIPTION

Anatomy

Figure 1:
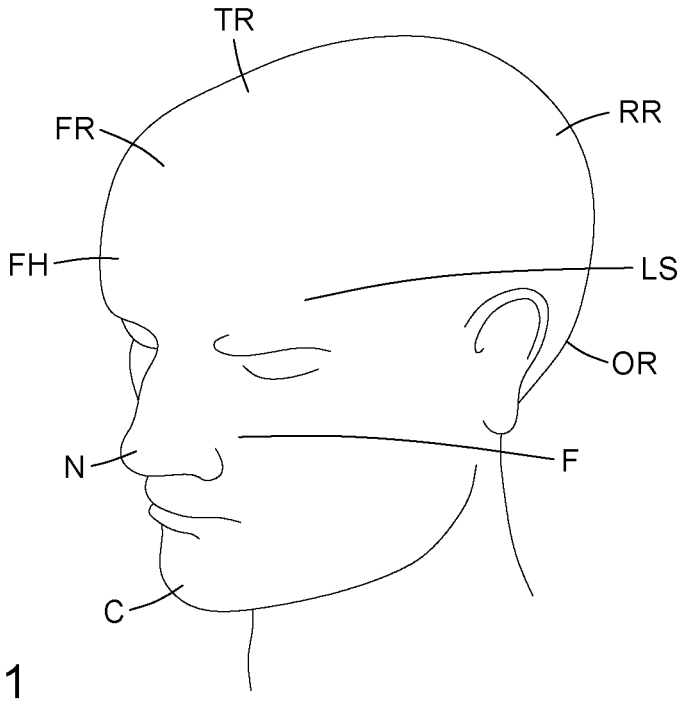
FIG. 1 is a schematic front perspective view of a head of a wearer.
Figure 2:
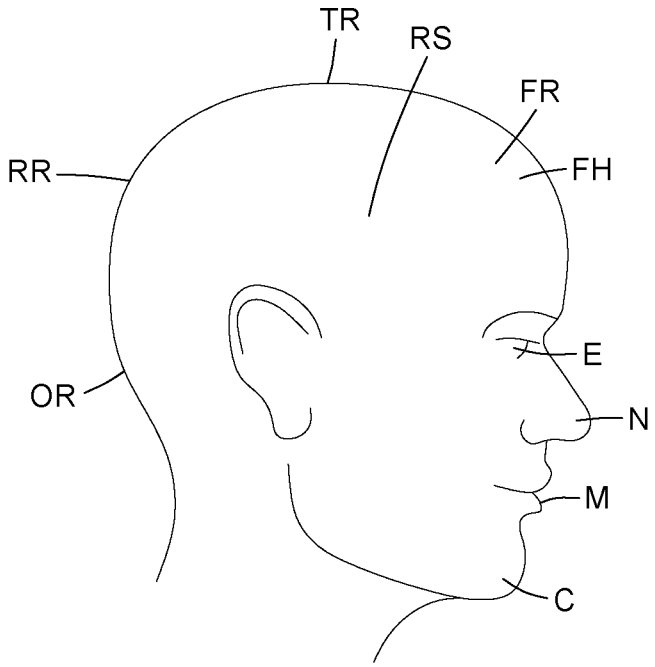
FIG. 2 is a schematic side view of the wearer's head of FIG. 1.

FIGS. 1 and 2 show a wearer's head comprising a front region FR, right and left side regions RS, LS, a rear region RR, and a top region TR. The front region FR includes a face F of the wearer, eyes E, a nose N and a mouth M of the wearer' face F, a chin C, a forehead FH. The right and left side regions RS, LS are located between the front region FR and the rear region RR of the head and include right and left temples and ears and right and left lateral parts of the head in right and left temporal bone areas of the head. The rear region RR has a rear upper part and an occipital region OR comprising an occipital protuberance in a parietal bone area and occipital bone area.

Helmet

Variants, examples and preferred embodiments of the present disclosure are described hereinbelow. More particularly, the figures show a sport helmet 10 for protecting the wearer's head in accordance with an embodiment of the present disclosure. In this embodiment, the sport helmet 10 is a hockey helmet for protecting the head of the wearer who is a hockey player. However, the present disclosure is not limited to any particular type of sport helmet. For example, a sport helmet constructed using principles described herein in respect of the sport helmet 10 may be used for protecting the head of a player of another type of contact sport in which there are significant impact forces on the player due to player-to-player and/or player-to-object contact (lacrosse or football for instance). It is also understood that the sport helmet may be for protecting the head of a wearer involved in a sport other than a contact sport (e.g., bicycling, motorcycle, skiing, snowboarding, horseback riding or another equestrian activity, etc.).

The sport helmet 10 defines a cavity for receiving the wearer's head to protect the head when the sport helmet 10 is impacted (e.g., when the sport helmet 10 hits a board, ice or other playing surface or is struck by a puck, ball, a lacrosse or hockey stick, or when the player is receiving a hit (e.g., body check) by another player and the head of the player is hit directly or indirectly).

The sport helmet 10 has a longitudinal axis LA, a transversal axis TA and a vertical axis VA that respectively define a front-back direction, a left-right direction and a vertical direction of the sport helmet 10. The longitudinal axis LA may be seen as an axis that resides within an imaginary longitudinal plan that bisects the helmet which defines left and right sides on each side of the plane.

The sport helmet 10 has an outer shell 12 comprising a first or front shell 14 and a second or rear shell 16 at least partially enclosing an inner padding 18. The first and second shells 14, 16 may be made of a relatively rigid material, such as polyethylene, NYLON, polycarbonate materials, thermoplastics, or thermosetting resins or any other suitable material. The outer shell 12 has an outer surface defined by first and second outer surfaces 20, 22 of the first and second shells 14, 16.

The sport helmet 10 may also comprise ear loops and a chinstrap for securing the sport helmet 10 to the wearer's head. The sport helmet 10 may further comprise ear protectors for protecting the left and right ears of the wearer.

Figure 3:
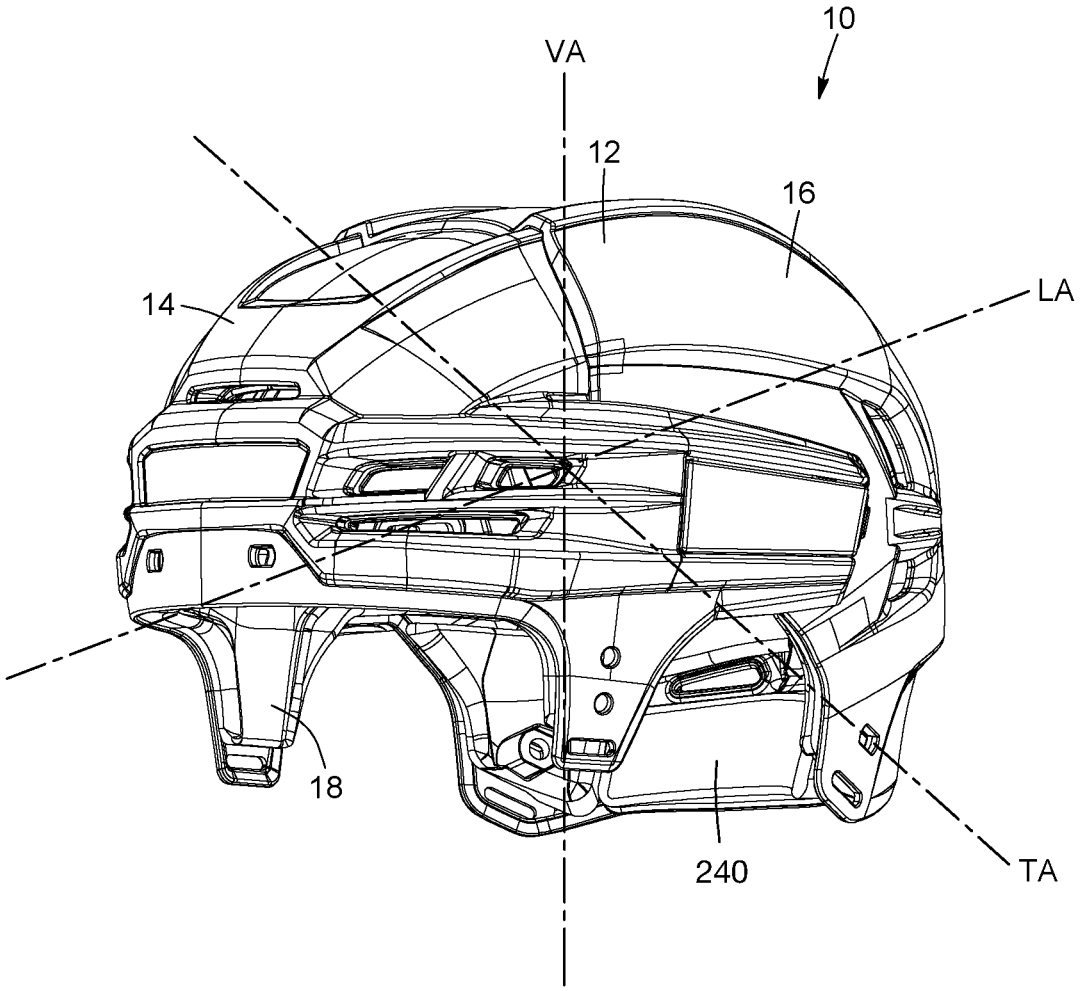
FIG. 3 is a schematic front three dimensional view of a sport helmet in accordance with one embodiment.

The sport helmet 10 is herein an adjustable sport helmet wherein the outer shell 12 and the inner padding 18 are adjustable to adjust the fit of the sport helmet 10 on the wearer's head. To that end, the first shell 14 and its inner padding are movable relative to the second shell 16 and its inner padding in a longitudinal direction defined by the longitudinal axis LA (FIG. 3) to adjust the fit of the sport helmet 10 on the wearer's head. It is understood that the expression "the first shell moves relative to the second shell" covers movements of the first and second shells in relation to each other wherein both shells are movable in relation to each other, wherein only the first shell is movable in relation to the second shell or wherein only the second shell is movable in relation to the first shell. Relative movement of the first and second shells for adjustment purposes may be along the longitudinal axis in the front-back direction of the sport helmet 10 such that the front-back internal dimension of the cavity of the sport helmet 10 is adjusted.

Figure 4:
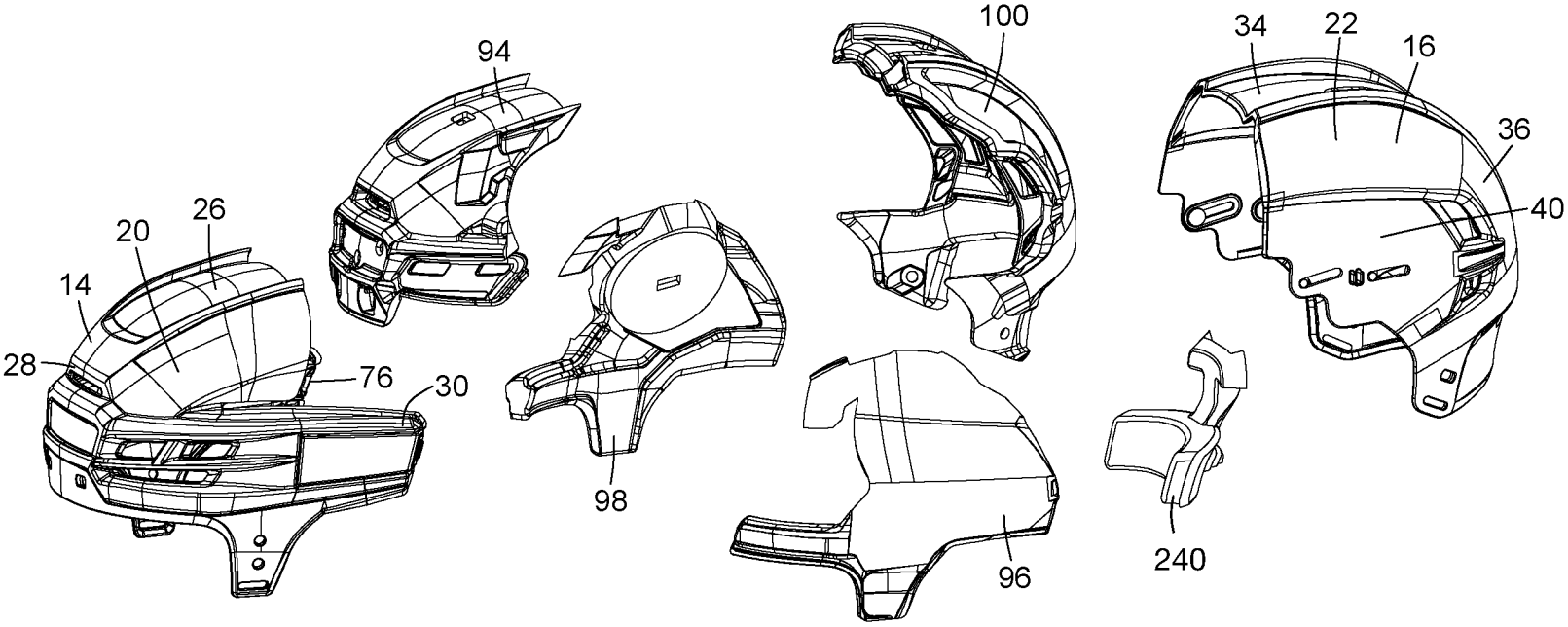
FIG. 4 is a schematic left side three dimensional exploded view of the sport helmet of FIG. 3.
Figure 5:
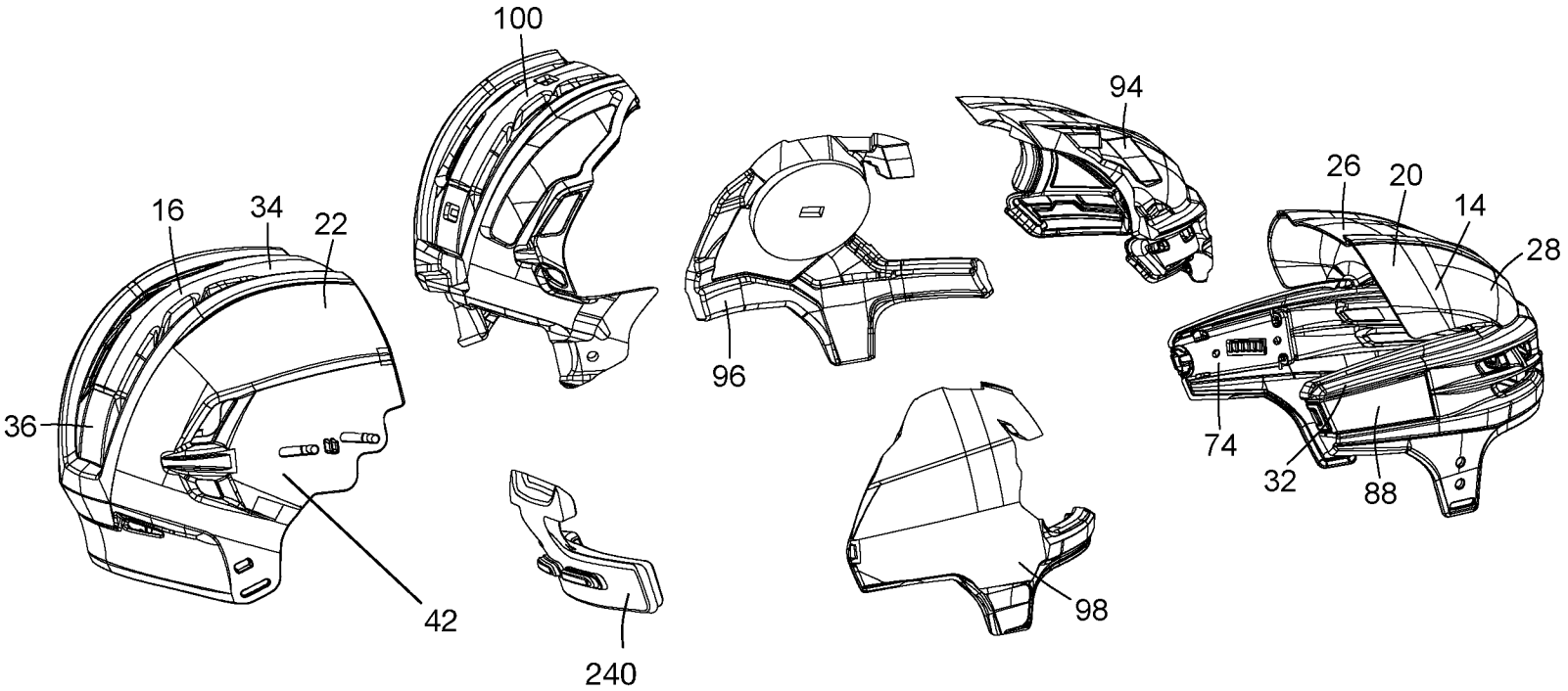
FIG. 5 is a schematic right side three dimensional exploded view of the sport helmet of FIG. 3.
Figure 6:
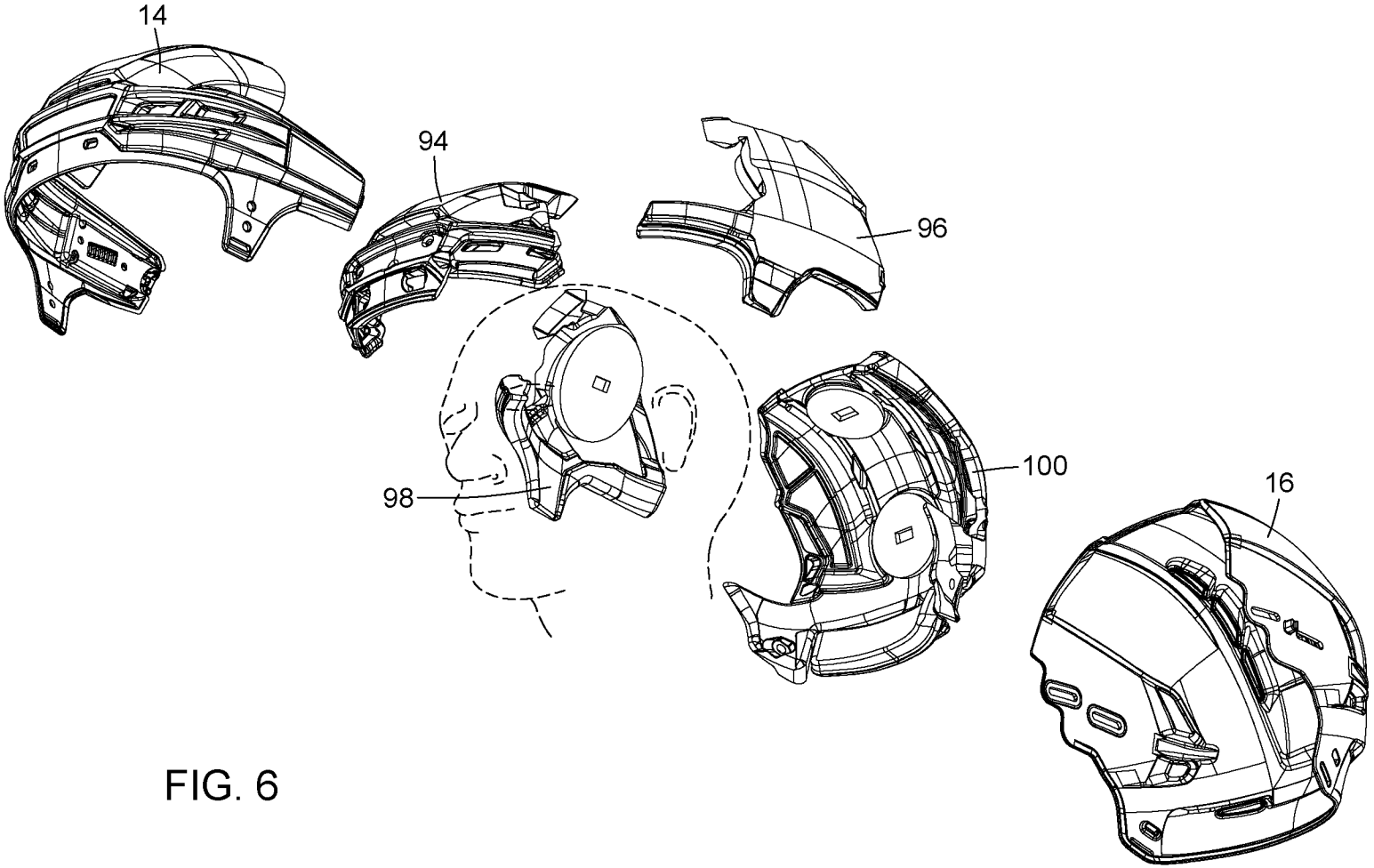
FIG. 6 is a schematic left front side three dimensional exploded view of the sport helmet of FIG. 3.
Figure 7:
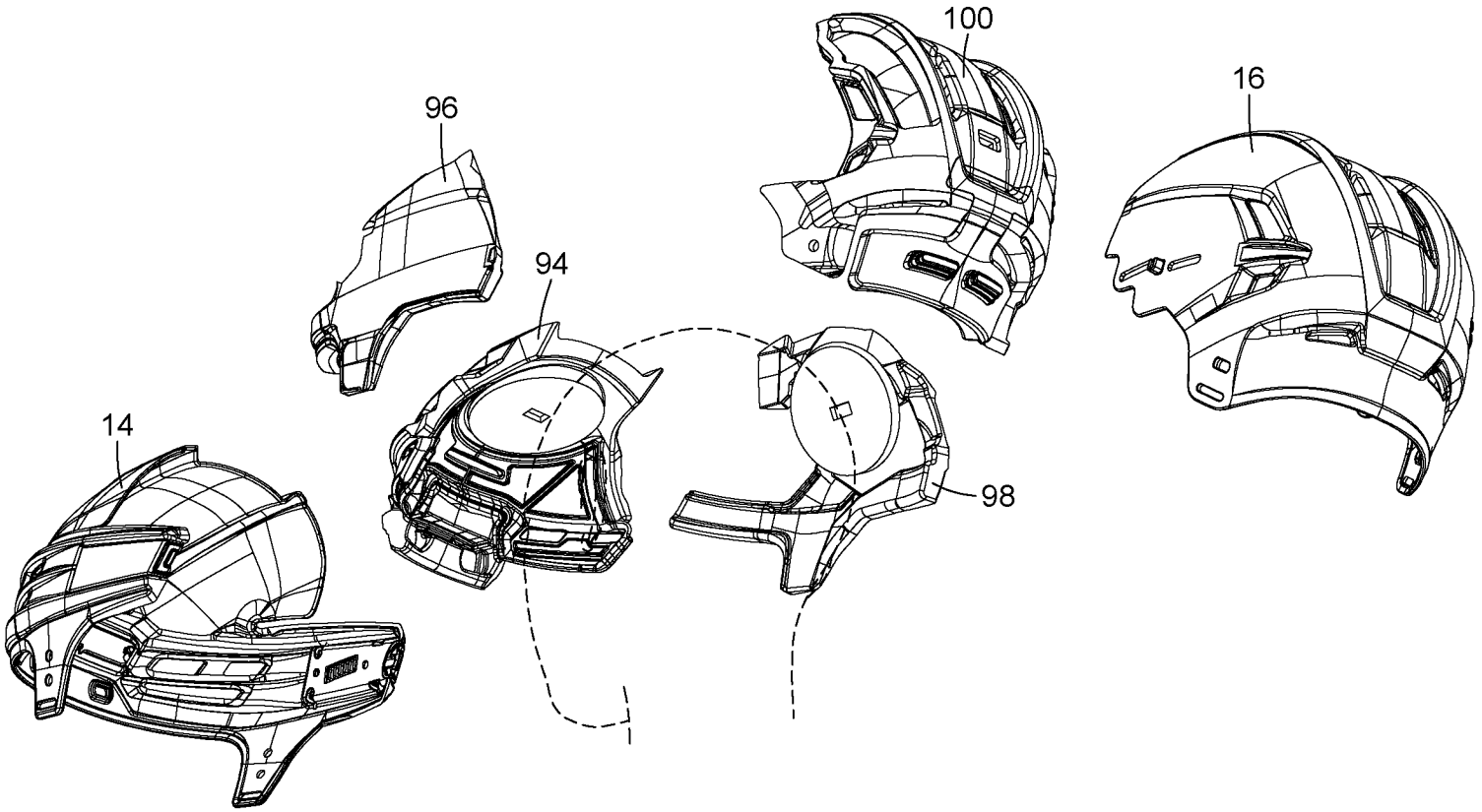
FIG. 7 is a schematic left rear side three dimensional exploded view of the sport helmet of FIG. 3.
Figure 8:
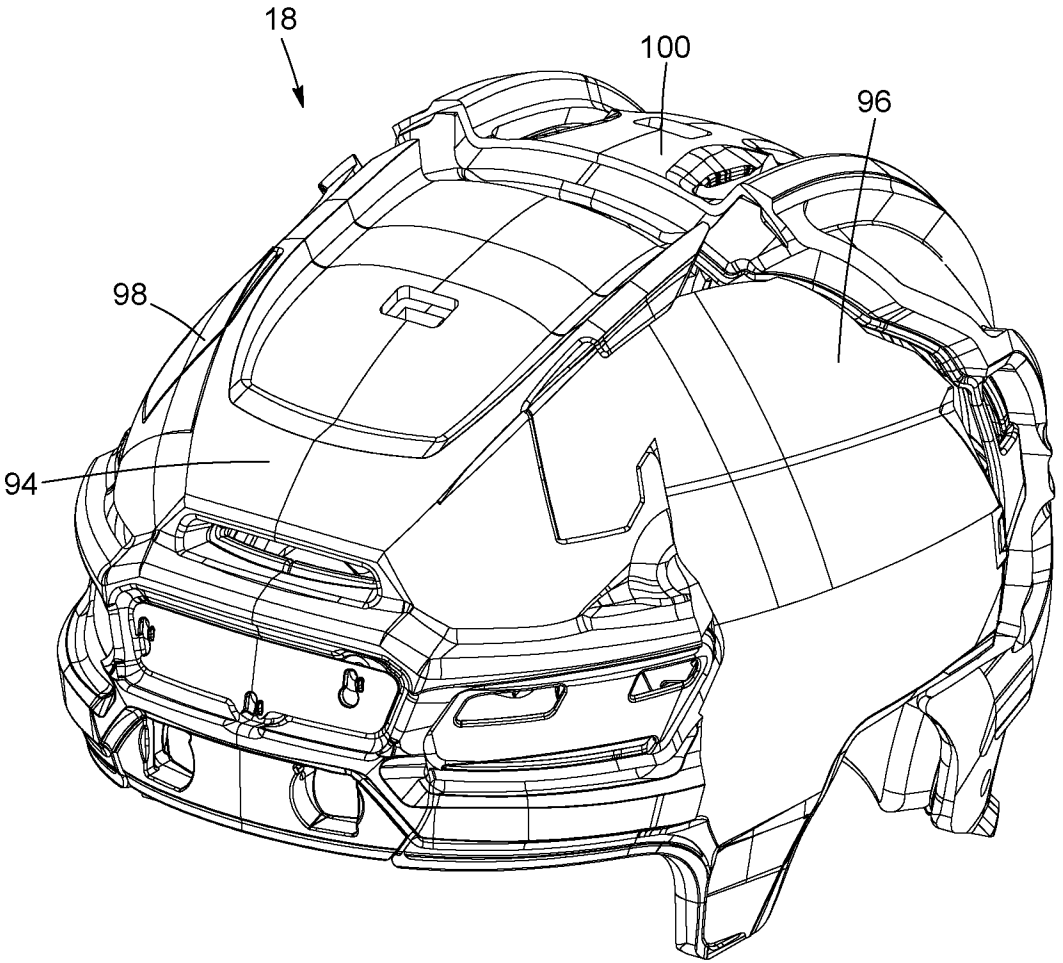
FIG. 8 is a schematic front perspective view showing an inner padding of the sport helmet of FIG. 3.

Referring to FIGS. 4-5, the first shell 14 comprises a top portion 26, a front portion 28 and left and right side portions 30, 32 extending rearwardly from the front portion 28. The second shell 16 comprises a top portion 34, a rear portion 36 and left and right side portions 40, 42 extending forwardly from the rear portion 36. The first and second shells 14, 16 of the sport helmet 10 at least partially enclose the inner padding 18.

Referring to FIGS. 4 to 8, the inner padding 18 comprises a first padding portion 94 for covering at least part of the front region FR and the top region TR of the wearer's head, left and right side padding portions 96, 98 for covering at least partially the left and right side regions LS, RS of the wearer's head, and a second padding portion 100 for covering at least part of the rear region RR of the wearer's head. In the sport helmet 10, the first and second padding portions 94, 100 are front and rear padding portions.

Each of the first, left, right and second padding portions 94, 96, 98, 100 comprises shock-absorbing material to absorb impact energy when the sport helmet 10 is impacted. For example, the shock-absorbing material may include a polymeric cellular material, such as a polymeric foam (e.g., expanded polypropylene (EPP) foam, expanded polyethylene (EPE) foam, vinyl nitrile (VN) foam, polyurethane foam, or any other suitable polymeric foam material), or expanded polymeric microspheres. In some cases, the shock-absorbing material may include an elastomeric material (e.g., a rubber such as styrene-butadiene rubber or any other suitable rubber); a polyurethane elastomer such as thermoplastic polyurethane (TPU); any other thermoplastic elastomer; etc.). In some cases, the shock-absorbing material may include a fluid (e.g., a liquid or a gas), which may be contained within a container (e.g., a flexible bag, pouch or other envelope) or implemented as a gel (e.g., a polyurethane gel). Any other material with suitable impact energy absorption may be used for the first, left, right and second padding portions 94, 96, 98, 100. It is understood that the inner padding 18 may comprise any number of pads and the sport helmet 10 may also comprise other types of pads such as comfort pads made of polymeric foam such as polyvinyl chloride (PVC) foam or polyurethane foam.

The first, left, right and second padding portions 94, 96, 98, 100 define a three-dimensional external configuration that matches the three-dimensional internal configuration of the first and second shells 14, 16 of the sport helmet 10 and are mounted to the first and second shells 14, 16 by any suitable affixing means, such as glue, stitches, tacks, staples or rivets or simply by press fitting of the padding portions within the outer shell.

It is understood that the first and second shells 14, 16 and the first, left, right and second padding portions 94, 96, 98, 100 may comprise ventilation holes, passages or apertures for allowing air to circulate around the wearer's head.

Rotational and Linear Acceleration Mitigation

The sport helmet 10 comprises a rotational impact protection construction. Direct impacts against a helmet (outer shell) provide impacts that are the result of a moving object contacting the helmet such as an elbow or a shoulder of a player impacting the outer shell helmet or when the helmet is moving and comes in contact with a stationary object. Linear acceleration occurs when an object with mass and velocity contacts the outer shell helmet or when the helmet is moving with mass and velocity and the resulting acceleration from the impact against the outer shell is in a linear or straight manner. Rotational acceleration occurs when an object with mass and velocity contacts the outer shell helmet or when the helmet is moving with mass and velocity and the resulting acceleration from the impact against the outer shell is angular or not in a straight manner.

The sport helmet 10 thus comprises a construction that is adapted to absorb and reduce the rotational acceleration of the wearer's head as a result of an impact against the outer shell 12. To that end, the inner padding 18 comprises a base with a base surface for facing the wearer's head and a plurality of sections extending inwardly from the base and defining surface sections for facing the wearer's head and being at distances of the base surface. In use, upon an impact against the outer shell 12 of the sport helmet 10 and upon the initial impact dispersion into the sport helmet 10, the base surface remains free of contact with the wearer's head and the plurality of sections are first activated to absorb and reduce the rotational acceleration to the wearer's head.

Figure 9:
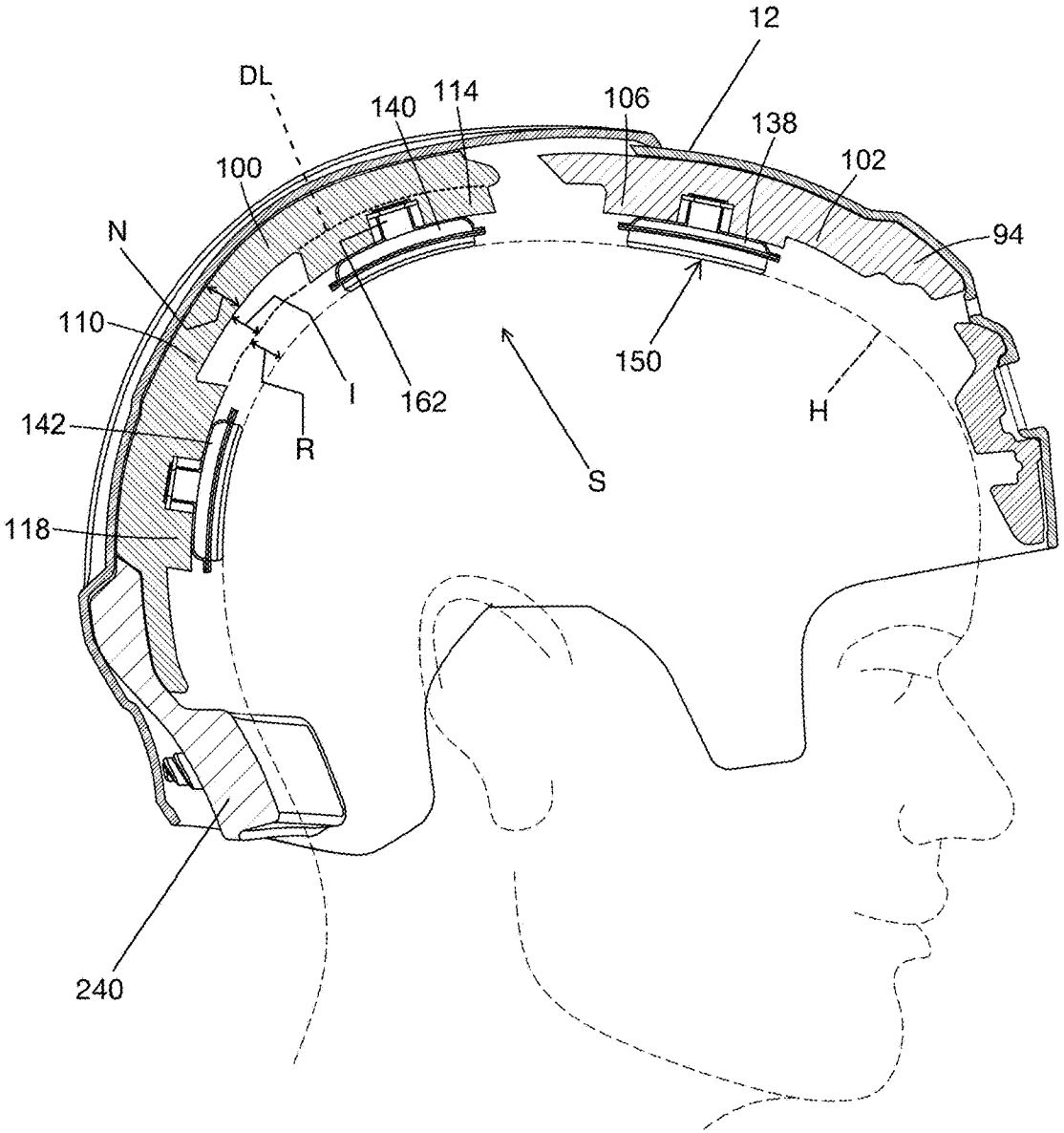
FIG. 9 is a schematic cross-sectional view of the sport helmet of FIG. 3.

Referring now to FIG. 9, the sport helmet 10 has an impact-mitigation system (IMS) S at least partially enclosed by the outer shell 12. The IMS S defines a head interface H shaped to substantially match a shape of the wearer's head. The impact-mitigation system (IMS) S has a rotational-impact-mitigation (RIM) layer R and a linear-impact-mitigation (LIM) layer N. An intermediate layer I is disposed between the normal- and rotational-impact-mitigation layers R, N. The RIM layer R extends from the head interface H toward the outer shell 12. The LIM layer N extends from the outer shell 12 toward the RIM layer R. The RIM layer R is configured for absorbing impacts on the helmet 10 that are angled relative to the external surface of the outer shell 12. These impacts cause the helmet 10, and the wearer's head, to rotate and may induce concussions. The LIM layer N is configured for absorbing impacts on the helmet 10 that are at a 90 degrees angle relative to the outer surface of the outer shell 12.

The LIM layer N includes the inner padding 18 of the helmet 10. In the embodiment shown, the intermediate layer I is defined by the inner padding 18. More specifically, the intermediate layer I includes at least one pedestals, herein five pedestals. Although the pedestals are shown as being protrusions extending away from a remainder of the inner padding 18, it will be appreciated that the pedestals may be separate elements secured to an inwardly-facing face of the inner padding 18 with any suitable fixing means (e.g., fasteners, glue, etc.).

As will be explained hereinbelow, the RIM layer R is able, when impacted, to allow the helmet 10 to rotate relative to the wearer's head thereby limiting an amount of rotational force imparted to the wearer's head.

For the remainder of the present disclosure, the pedestals may be referred to as first, second, third, fourth, and fifth sections 106, 114, 118, 126, 134.

Figure 11:
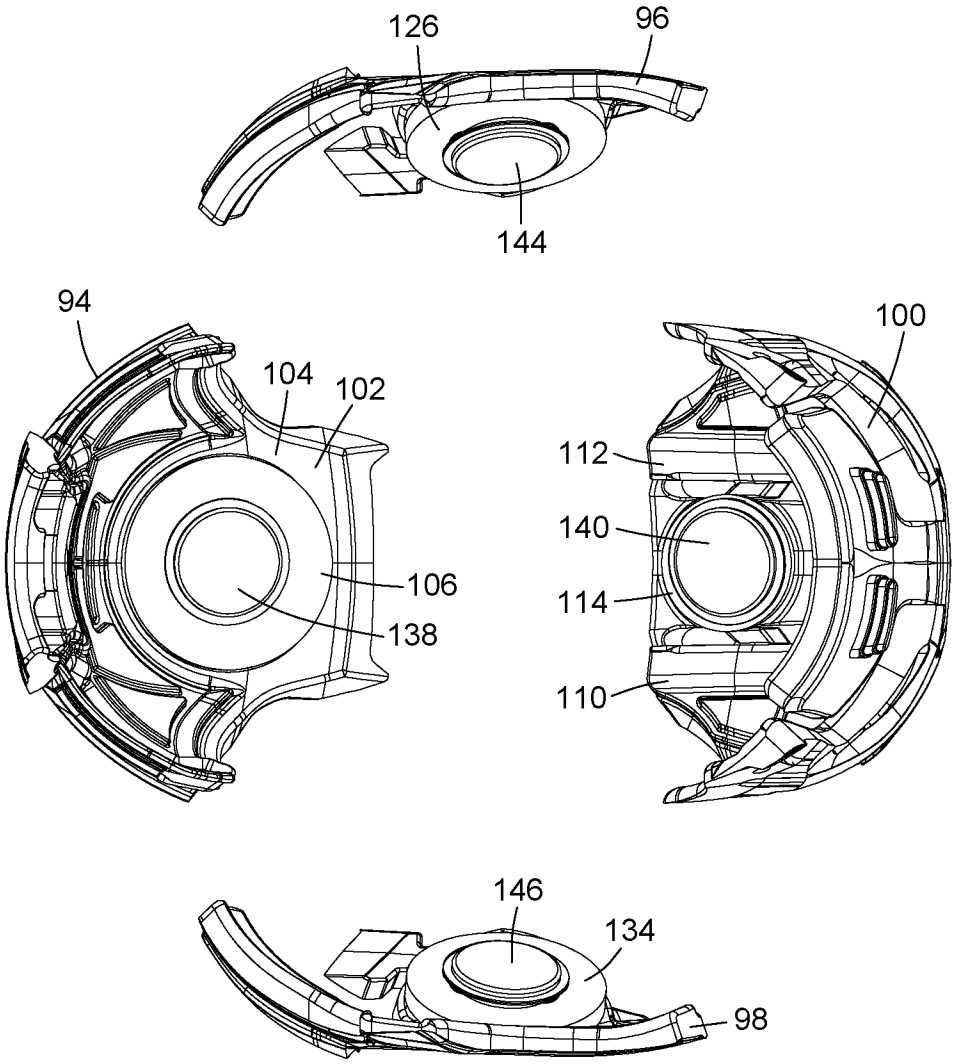
FIG. 11 is a schematic bottom perspective exploded view of the inner padding of FIG. 8 with tangential shock-absorbers secured thereto.
Figure 12:
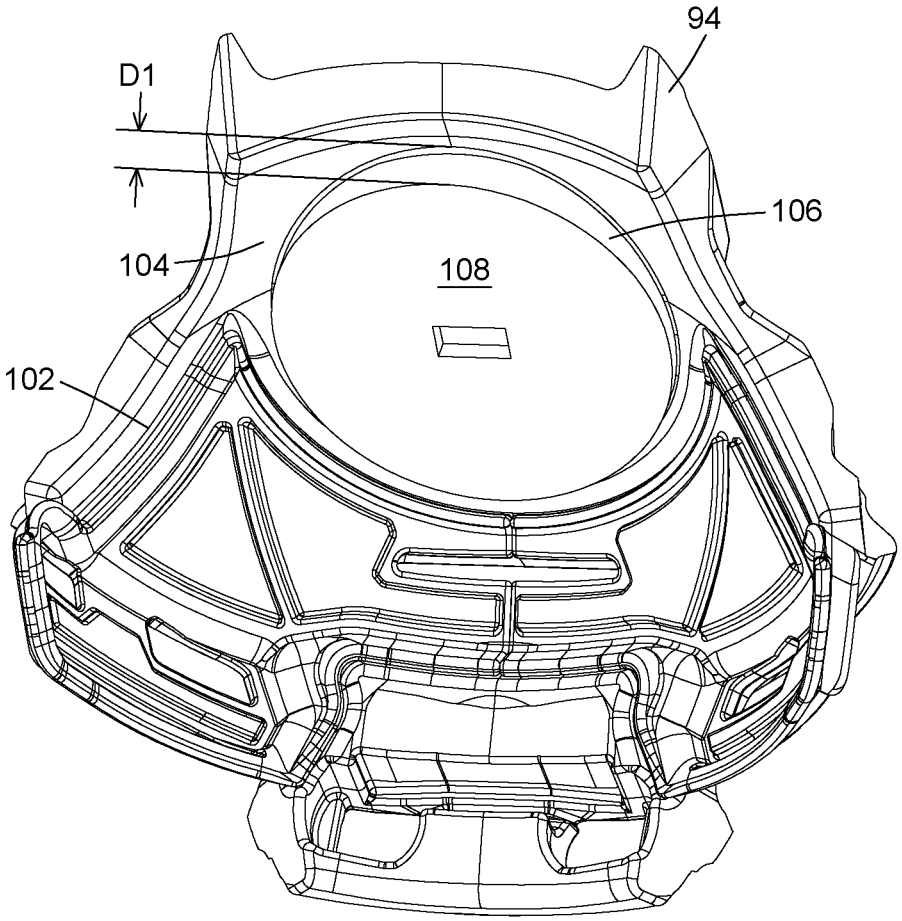
FIG. 12 is an enlarged schematic bottom perspective view of a front padding portion of the sport helmet of FIG. 3.
Figure 13:
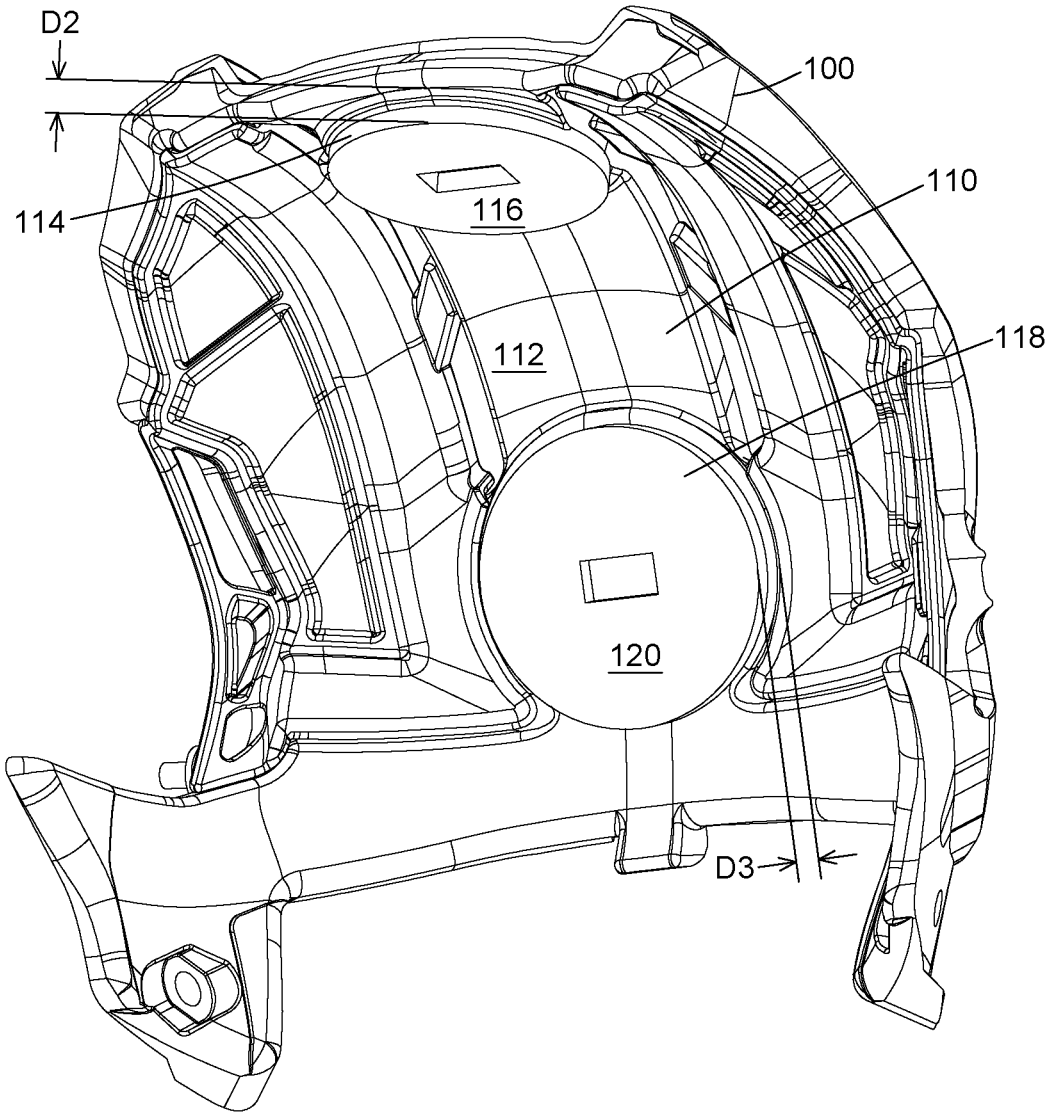
FIG. 13 is an enlarged schematic bottom perspective view of a rear padding portion of the sport helmet of FIG. 3.

Referring now to FIGS. 10-15, an exploded view showing the different sections of the inner padding 18, namely the first, left, right, and second padding portions 94, 96, 98, 100, is presented. As shown, the first portion 94 includes the first section, or first pedestal, 106 defining a surface 108 oriented toward the wearer's head and being distanced from a base surface 104 of the first padding portion 94. Similarly, the left, right, and second padding portions 96, 98, 100 define the second, third, fourth, and fifth sections, or second, third, fourth, and fifth pedestals, 114, 118, 126, 134 each defining a respective one of surfaces 116, 120, 128, 136 oriented toward the wearer's head and being distanced from a respective one of bases surfaces 112, 124, 132. As shown in FIG. 13, the third pedestal 118 is defined by the second padding portion 100. The surfaces 108, 116, 120, 128, 136 of the first, second, third, fourth, and fifth pedestals 106, 114, 118, 126, 134 may be curved to follow a contour of the wearer's head. Any suitable shapes of those surfaces are contemplated. For instance, the pedestal surfaces may be cup shaped.

Referring to FIG. 12, the first padding portion 94 is illustrated in greater detail and includes a base section 102 defining the base surface 104 from which the first section, or first pedestal, 106 protrudes. In the embodiment shown, the first section 106 extends from the base section 102 over a first distance D1 that varies between about 0.5 mm to about 5 mm. The first distance D1 is selected such that, in use, the base section 102 remains free of contact with the wearer's head. In other words, the first section 106 is designed to be first activated and then to absorb a portion of the linear acceleration of the wearer's head while the base 102 is designed to be activated later and to absorb and reduce another portion of the linear acceleration of the wearer's head.

Referring to FIG. 13, the second padding portion 100 is illustrated in greater detail and includes a base section 110 defining the base surface 112 from which the second section, or second pedestal, 114 and the third pedestal 118 protrude. In the embodiment shown, the second section 114 extends from the base section 110 over a second distance D2 that varies between about 0.5 mm to about 5 mm. In the embodiment shown, the third section 118 extends from the base section 110 over a third distance D3 that varies between about 0.5 mm to about 5 mm. The second and third distances D2, D3 are selected such that, in use, the base section 110 remains free of contact with the wearer's head. In other words, the second section 114 and the third section 118 are designed to be first activated and then to absorb a portion of the linear acceleration of the wearer's head while the base section 110 is designed to be activated later and to absorb and reduce another portion of the linear acceleration of the wearer's head.

Figure 14:
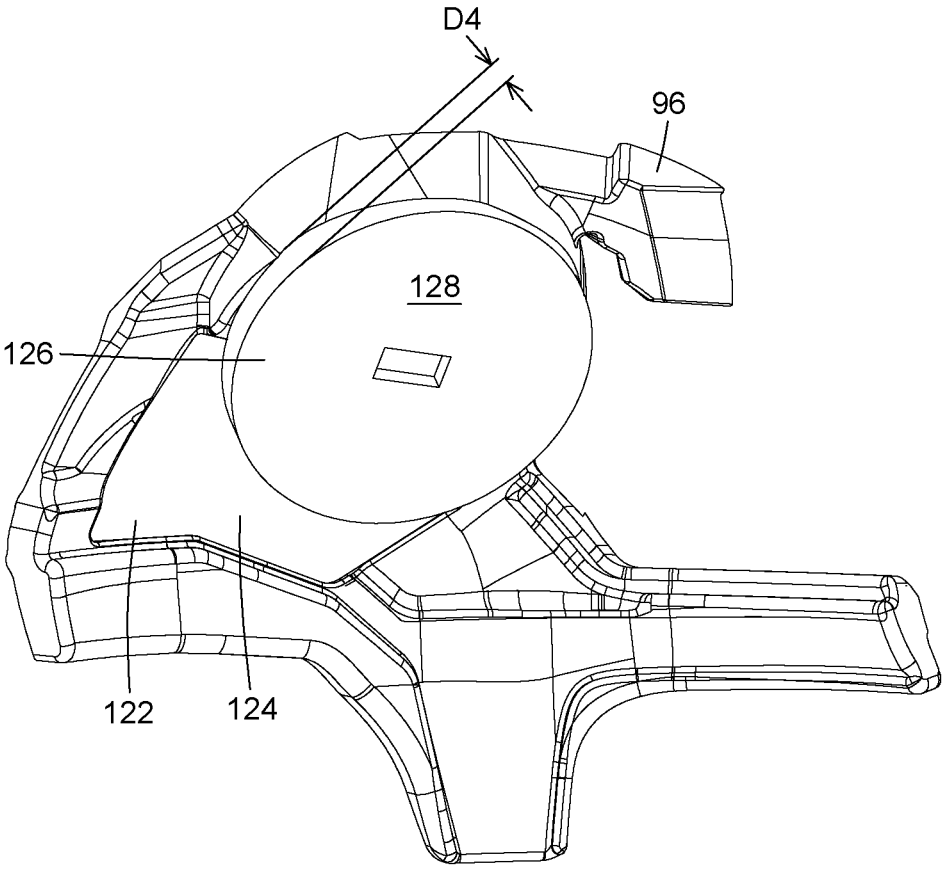
FIG. 14 is an enlarged schematic side perspective view of a left padding portion of the sport helmet of FIG. 3.

Referring to FIG. 14, the left padding portion 96 is illustrated in greater detail and includes a base section 122 defining the base surface 124 from which the fourth section, or fourth pedestal, 126 protrudes. In the embodiment shown, the fourth section 126 extends from the base section 122 over a fourth distance D4 that varies between about 0.5 mm to about 5 mm. The fourth distance D4 is selected such that, in use, the base section 122 remains free of contact with the wearer's head. In other words, the fourth section 126 is designed to be first activated and then to absorb a portion of the linear acceleration of the wearer's head while the base section 122 is designed to be activated later and to absorb and reduce another portion of the linear acceleration of the wearer's head.

Figure 15:
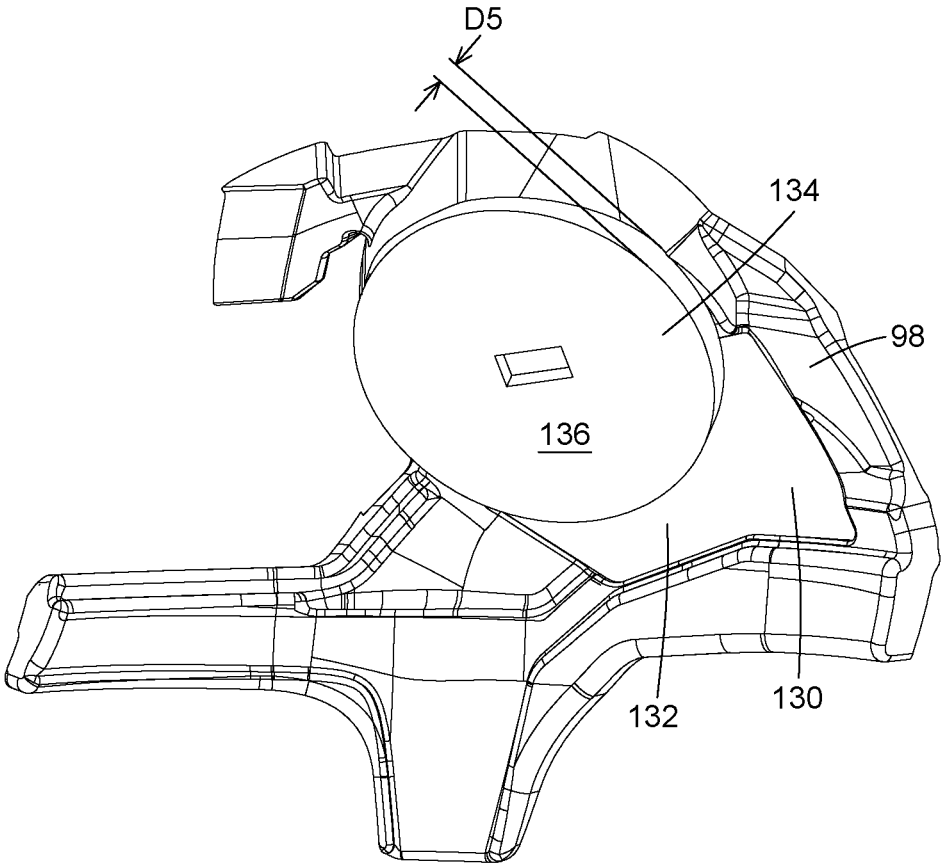
FIG. 15 is an enlarged schematic side perspective view of a right padding portion of the sport helmet of FIG. 3.

Referring to FIG. 15, the right padding portion 98 is illustrated in greater detail and includes a base section 130 defining the base surface 132 from which the fifth section, or fifth pedestal, 134 protrudes. In the embodiment shown, the fifth section 134 extends from the base section 130 over a fifth distance D5 that varies between about 0.5 mm to about 5 mm. The fifth distance D5 is selected such that, in use, the base section 130 remains free of contact with the wearer's head. In other words, the fifth section 134 is designed to be first activated and then to absorb a portion of the linear acceleration of the wearer's head while the base section 130 is designed to be activated later and to absorb and reduce another portion of the linear acceleration of the wearer's head.

The first, second, third, fourth and fifth sections 106, 114, 118, 126, 134 are anatomically shaped to follow the wearer's head. The first section 106 may extend from the inner padding to be positioned over a first region of the front region FR and top region TR of the wearer's head, the section 114 may extend from the inner padding to be positioned over a second region of the top region TR of the wearer's head, the third section 118 may extend from the inner padding to be positioned in a third region of the rear region RR of the wearer's head, the fourth section 126 may extend from the inner padding to be positioned over a fourth region of the left side LS and top region TR of the wearer's head, and the fifth section 134 may extend from the inner padding to be positioned over a fifth region of the right side RS and top region TR of the wearer's head.

In the embodiment shown, the first, second, third, fourth, and fifth pedestals 106, 114, 118, 126, 134 are monolithic with their associated padding portions 94, 96, 98, 100. Alternatively, they may be secured to said padding portions using any suitable means.

The first, second, third, fourth, and fifth distances D1, D2, D3, D4, D5 represent offsets between the surfaces 108, 116, 120, 128, 136 of the pedestals and the base sections from which they protrude. These distances may be considered as the heights of these pedestals. The distance between the linear-impact mitigation layer N and the rotational-impact-mitigation layer R ranges from 0.5 to 5 mm.

As indicated previously, each of the first, left, right and second padding portions 94, 96, 98, 100 comprises shock-absorbing material to absorb impact energy when the sport helmet 10 is impacted. For example, the shock-absorbing material may include a polymeric cellular material, such as a polymeric foam (e.g., expanded polypropylene (EPP) foam, expanded polyethylene (EPE) foam, vinyl nitrile (VN) foam, polyurethane foam, or any other suitable polymeric foam material), or expanded polymeric microspheres.

Each of the first, second, third, fourth and fifth sections 106, 114, 118, 126, 134 may be made of the same material than the material of the base sections 102, 110, 122, 130 of the first, left, right and second padding portions 94, 96, 98, 100. Alternatively, each of the first, second, third, fourth and fifth sections 106, 114, 118, 126, 134 may be made of a different material than the material of the base sections such that the first, second, third, fourth and fifth sections 106, 114, 118, 126, 134 present different mechanical properties or characteristics (e.g. rigidities, densities, compression rates, etc.) than the bases. A dashed line DL is shown in FIG. 9 to illustrate a possible intersection between the second section 114 and the base section 110, which may be made of different materials.

In one variant, each of the first, second, third, fourth and fifth sections 106, 114, 118, 126, 134 may be made of a first material and each of the base sections 102, 110, 122, 130 of the first, left, right and second padding portions 94, 96, 98, 100 may be made of a second material, the first and second materials being made from a material selected in the group consisting of expanded polypropylene foam, expanded polyethylene foam, vinyl nitrile foam and expanded polymeric foam.

In another variant, the second material may be different than the first material. For instance, the second material may be made from a material selected in the group consisting of expanded polypropylene foam, expanded polyethylene foam, vinyl nitrile foam and expanded polymeric foam and the first material may be made from a material selected in the group consisting of rubber, styrene-butadiene rubber, polyurethane elastomer, polyvinyl chloride foam or polyurethane foam.

The first, second, third, fourth and fifth sections 106, 114, 118, 126, 134 are spaced from each other and cover only limited regions of the inside surface of the padding 18.

It is understood that the first, second, third, fourth and fifth distances D1, D2, D3, D4 and D5 of the first, second, third, fourth and fifth sections 106, 114, 118, 126, 134, i.e. the distances between the section surfaces and the base surfaces, may be different or identical.

It will be appreciated that the base surfaces 104, 112, 124, 132 of the base sections 102, 110, 122, 130 are adapted to be at base distances from the wearer's head. The first, second, third, fourth and fifth surfaces 108, 116, 120, 128, 136 of the first, second, third, fourth and fifth sections 106, 114, 118, 126, 134 are adapted to be at section distances from the wearer's head. The section distances are smaller than the base distances.

Referring to FIG. 11, in the embodiment shown, each of the pedestals 106, 114, 118, 126, 134 is overlapped by a respective one of five tangential shock absorbers 138, 140, 142, 144, 146. These shock absorbers are part of the RIM layer R.

Figure 16:
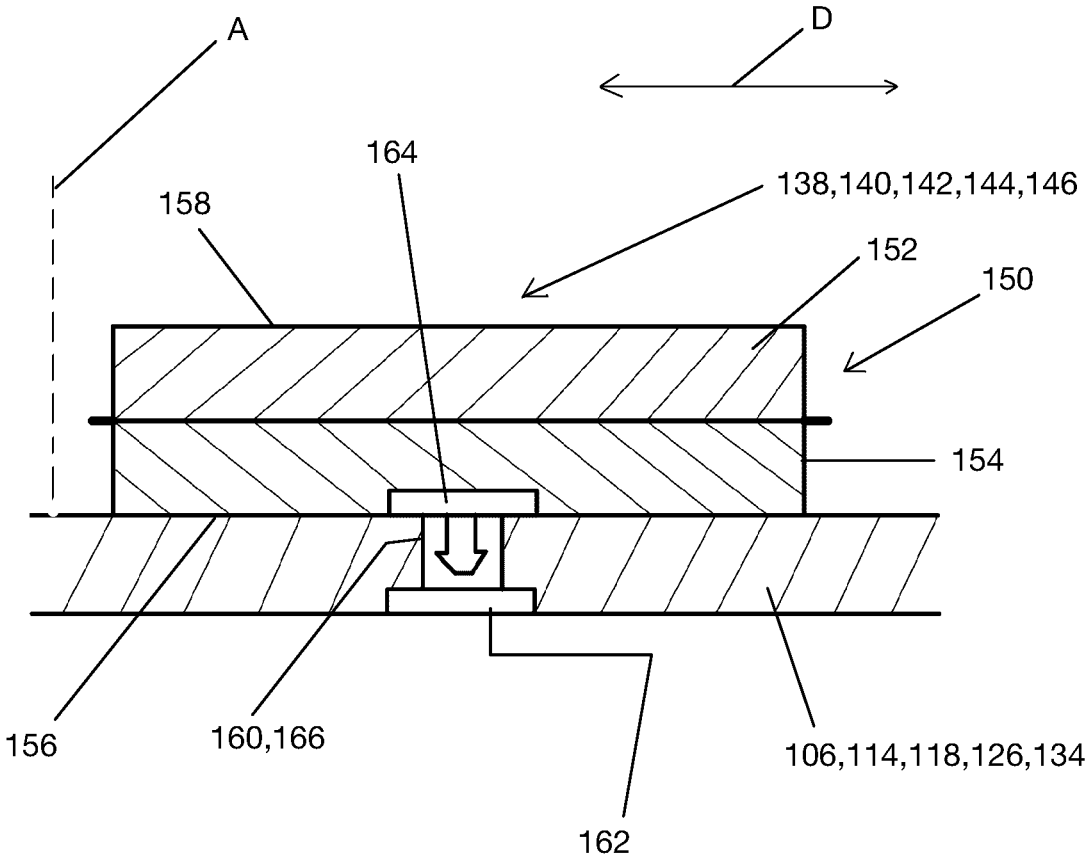
FIG. 16 is a schematic cross-sectional view of a tangential shock absorber in accordance with one embodiment.

Referring to FIG. 16, one of the tangential shock absorbers 138, 140, 142, 144, 146 is shown in greater detail and includes a shearable member 150, which herein includes two bladders 152, 154 disposed atop one another. The term "shearable" as used herein in the context of the "shearable member" is understood to be an element that is readily capable of shearing without self-destruction, wherein displacement of one portion or one face thereof relative to another portion or another face thereof is possible when the member is exposed to a shear force. This displacement may be repeatable, without the member being plastically deformed.

Each of the tangential shock absorbers has a first face 156 in abutment against a respective one of the surfaces 108, 116, 120, 128, 136 of the pedestals 106, 114, 118, 126, 134 and an opposed second face 158 being part of the head interface H and adapted to contact the wearer's head. It will be appreciated that each of the tangential shock absorbers 138, 140, 142, 144, 146 may include solely one bladder or more than two bladders. The bladders may include different fluids varying by their viscosity and/or by their thicknesses.

The first and second faces 156, 158 are movable one relative to the other in a direction D having a radial component relative to axes (only one axis A shown herein) normal to the surfaces 108, 116, 120, 128, 136 of the pedestals 106, 114, 118, 126, 134. In other words, the first and second faces 156, 158 are translatable one relative to the other in the direction D that is at least partially tangential to the head interface H. This translation is allowed by shearing the shearable member 150. Herein, "translatable" implies that the first face 156 may become offset from the second face 158. This may allow the helmet 10 to follow a first rotational movement having a first amplitude after being impacted with a force being not normal to the outer shell 12 whereas the second face 158 may follow a second rotational movement having a second amplitude being less than the first amplitude. The ability of the shearable member 150 to shear may mitigate a magnitude of a rotational force imparted to the outer shell 12 of the helmet 10 and transmitted to the wearer's head. Herein, "mitigate" implies attenuation or decrease of a magnitude of a force transmitted to the wearer's head. In other words, the RIM layer R (FIG. 9) may allow to create a mitigation ratio of the helmet 10 corresponding to a magnitude of a force seen by the wearer's head to a magnitude of a force exerted on the outer shell 12 of the helmet 10. The RIM layer R allows this ratio to be less than one.

The bladders 152, 154 may be flexible containers, bags, pouches or envelopes containing a liquid, a gas or a gel. The layer of the bladder may be made of an elastic material. The bladder is a closed bladder containing a liquid, gas or gel and the bladder is adapted to absorb rotational acceleration by compression and/or shearing movement of the bladder. The liquid may be a low friction liquid such as any suitable oil. The bladder may have a thickness of from 1 mm to 5 mm.

Figure 10:
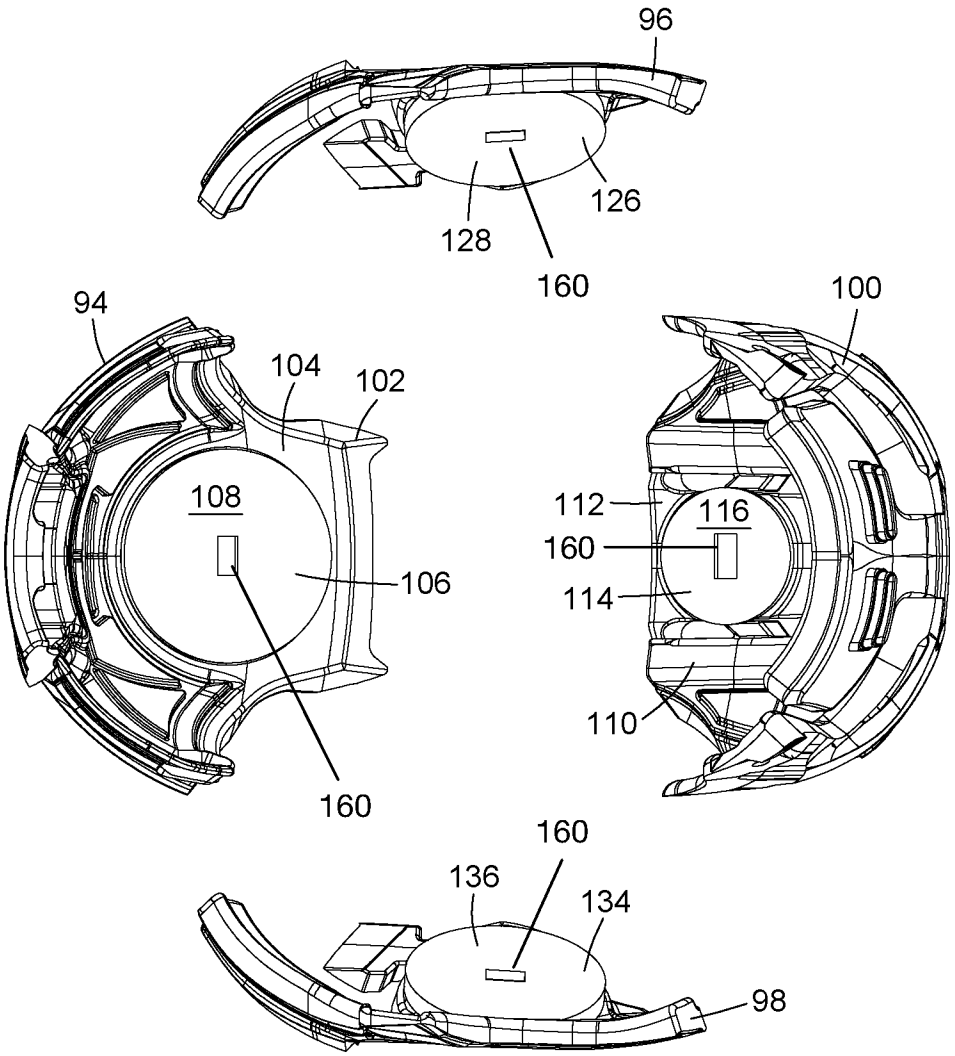
FIG. 10 is a schematic bottom perspective exploded view of the inner padding of FIG. 8.

Referring to FIGS. 10 and 16, in the present embodiment, each of the pedestals 106, 114, 118, 126, 134 defines an aperture 160, which are herein depicted as square apertures but other shapes are contemplated, for receiving a rivet 162 therein. The rivets 162 have each a male member 164 and a female member 166. Herein, the male members 164 of the rivets 162 are secured to the tangential-shock absorbers 138, 140, 142, 144, 146 whereas the female members 166 are secured to the pedestals 106, 114, 118, 126, 134. The opposite is alternatively contemplated. The rivets 162 may be snap rivets or ratchet rivets. Any suitable fixing means known in the art may be used without departing from the scope of the present disclosure. The rivets 162 may be compressible. For instance, the rivets 162 may be made of a compressible material such as TPR or a low hardness TPU material so as to be able to absorb impact.

Alternatively, the tangential shock absorbers 138, 140, 142, 144, 146 may be attached to the respective base sections 102, 110, 122, 130 with bands such elastic bands that may offer further degree of movement or elasticity to the bladder with respect to the base sections 102, 110, 122, 130 upon an impact against the outer shell 12. The apertures may contain two opposed member biased toward one another and operable to pinch the elastic bands to maintain the tangential shock absorbers 138, 140, 142, 144, 146 secured to the pedestals. The tangential shock absorbers 138, 140, 142, 144, 146 may be glued to the pedestals.

In use, upon an impact against the outer shell 12, the base surfaces 104, 112, 124, 132 of the base sections 102, 110, 122, 130 remain free of contact with the wearer's head at the initial impact dispersion into the helmet and the first, second, third, fourth and fifth tangential impact absorbers (e.g., bladders) 138, 140, 142, 144, 146 are first activated to absorb and reduce rotational acceleration of the wearer's head. Each of the bladders is also designed to absorb rotational acceleration by compression and/or shearing movement while maintaining a sufficient distance between the base surfaces 104, 112, 124, 132 and the wearer's head to allow rotation of the sport helmet 10 around the wearer's head for reducing rotational acceleration.

From the above description and drawings, it is understood that, in use, the surface of the core of the inner padding (e.g. base surfaces 104, 112, 124, 132 of the base sections 102, 110, 122, 130) does not contact the wearer's head when the outer shell 12 is first impacted and at the initial impact dispersion into the helmet and that the section of the core projecting inwardly from the core toward the head and having a surface at a distance of the core surface (e.g. the first, second, third, fourth and fifth sections 106, 114, 118, 126, 134) is designed to, upon an impact against the outer shell and upon the initial impact dispersion into the helmet, be first activated to absorb and reduce the rotational acceleration of the wearer's head.

Upon an impact imparted to the helmet 10, the wearer's head first contact the tangential shock absorbers 138, 140, 142, 144, 146. Then, the surfaces 108, 116, 120, 128, 136 of the pedestals 106, 114, 118, 126, 134 may contact the wearer's head. Then, the base sections 102, 110, 122, 130 may contact the wearer's head. It will be appreciated that not all sections contact the wearer's head with each impact. For instance, a light impact may cause solely the tangential shock absorbers to contact the wearer's head. With an increase of a magnitude of the force of the impact, the pedestal surfaces may contact the wearer's head. An even stronger impact may cause all of the tangential shock absorbers, the pedestals, and the base sections to contact the wearer's head.

Hence, each of the first, second, third, fourth and fifth sections or pedestals 106, 114, 118, 126, 134, having the tangential shock absorbers 138, 140, 142, 144, 146 secured thereto, is designed to absorb and reduce the rotational acceleration independently from each other and also independently from the base sections 102, 110, 122, 130 and each of those bases is rather designed to absorb and reduce the linear acceleration. In other words, the pedestals 106, 114, 118, 126, 134 are used to absorb, or mitigate, linear acceleration whereas the tangential shock absorbers 138, 140, 142, 144, 146 are used to absorb, or mitigate, rotational acceleration.

The first, second, third, fourth and fifth tangential shock absorbers 138, 140, 142, 144, 146 are designed to absorb and reduce the rotational acceleration independently from each other and also independently from the base sections 102, 110, 122, 130. Moreover, in use, when the wearer's head contacts the base surface (e.g. base surfaces 104, 112, 124, 132), the base (e.g. bases 102, 110, 122, 130) is then activated to absorb and reduce the linear acceleration of the wearer's head. The sections 106, 114, 118, 126, 134 and/or the tangential shock absorbers 138, 140, 142, 144, 146 are designed to be first activated to absorb and reduce the rotational acceleration upon initial impact against the outer shell 12 of the helmet 10 while the base sections 102, 110, 122, 130 are designed to be afterwards activated to absorb and reduce the linear acceleration.

Naturally, if the initial resulting acceleration from the impact against the outer shell 12 is solely and only in a linear or straight direction, it is understood that the sections 106, 114, 118, 126, 134 and/or the bladders 138, 140, 142, 144, 146 may then rather absorb and reduce the linear acceleration by compression movement of the sections and/or of the bladders, i.e. without shearing movement, and the bases 102, 110, 122, 130 may afterwards absorb and reduce the linear acceleration. However, as long as the initial impact against the outer shell generates a rotational acceleration of the wearer's head, the tangential shock absorbers 138, 140, 142, 144, 146 are designed to then be first activated to absorb and reduce the rotational acceleration of the wearer's head.

Occipital Inner Pad

Figure 17:
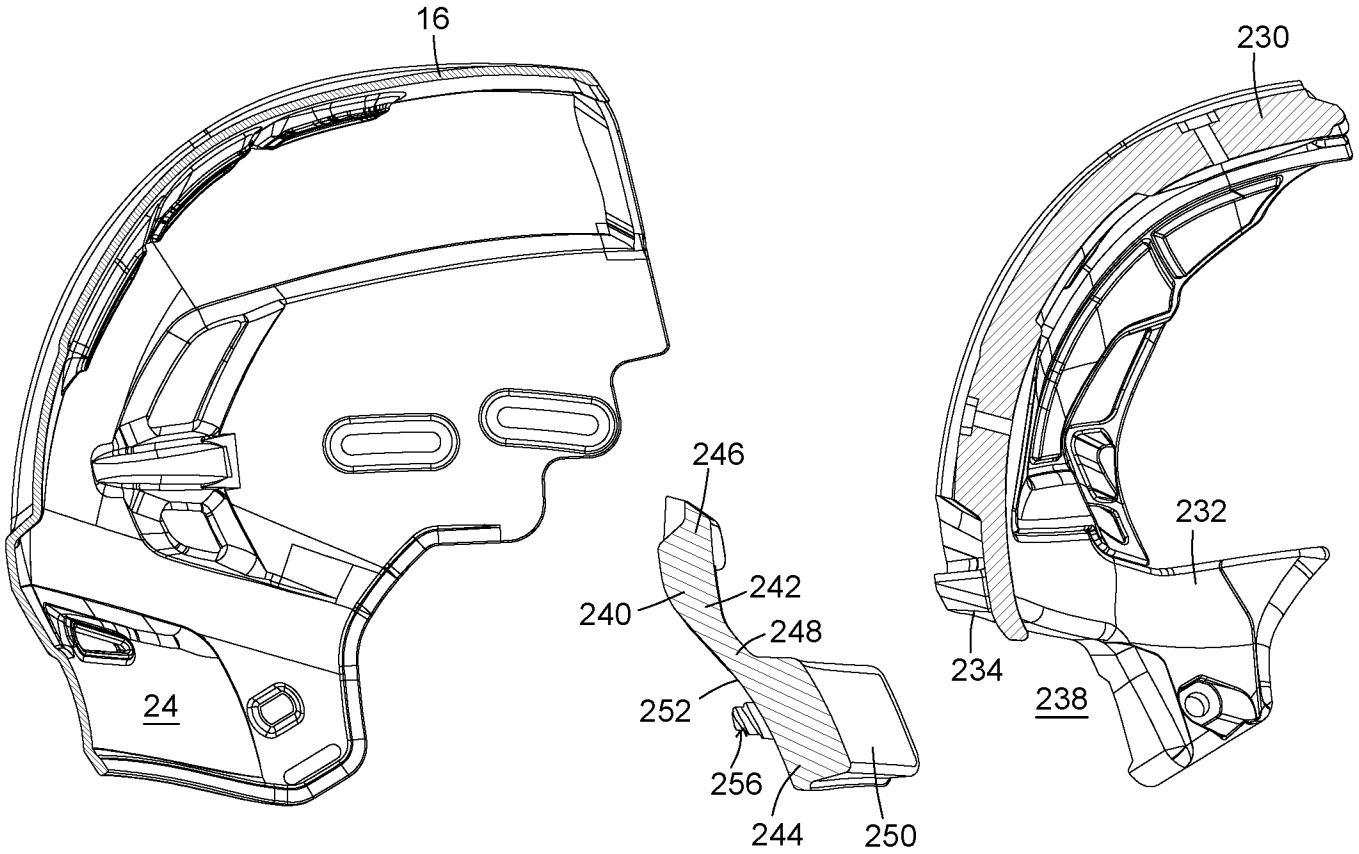
FIG. 17 is a schematic cross-sectional exploded view showing a rear shell portion, an occipital inner pad with biasing portions, and a rear padding portion of the sport helmet of FIG. 3.
Figure 18:
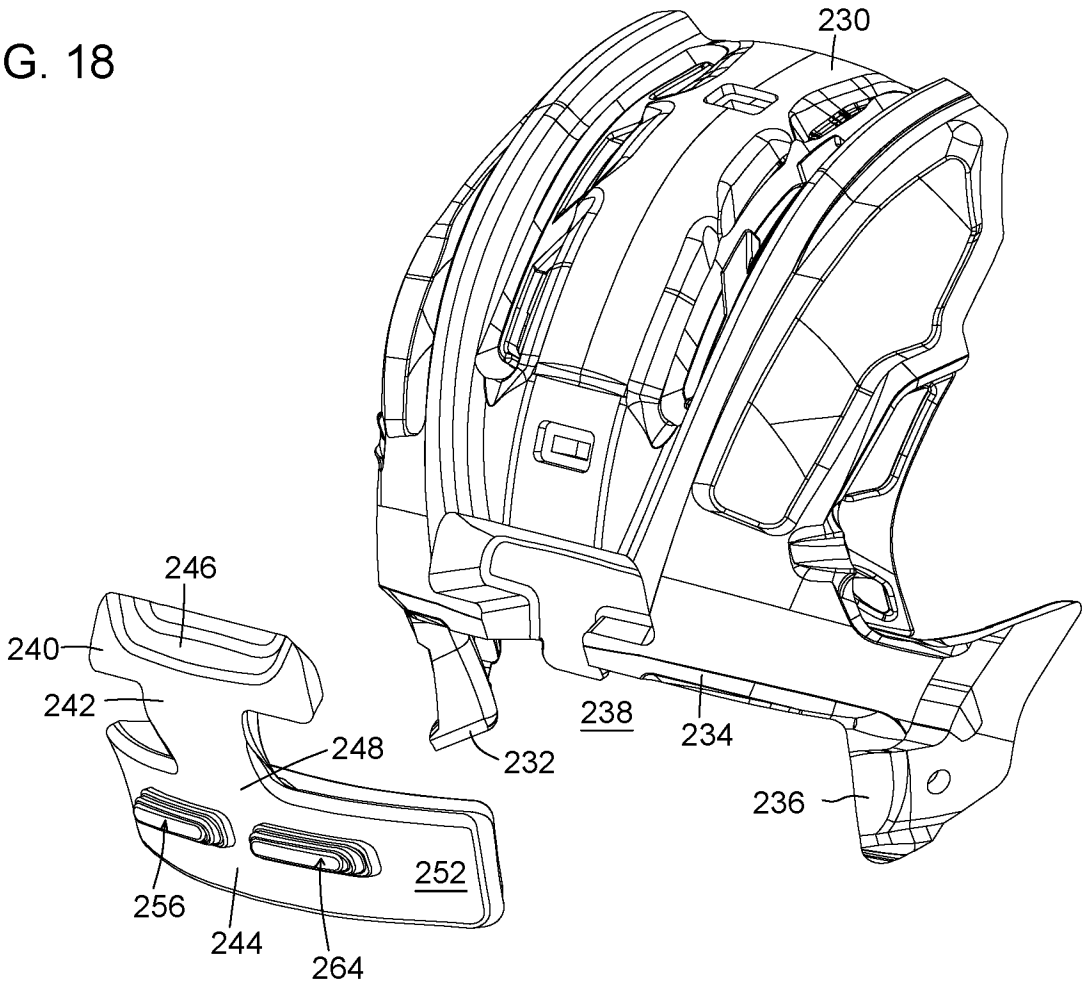
FIG. 18 is a schematic rear perspective exploded view showing the occipital inner pad with the biasing portions and the rear padding portion of the sport helmet of FIG. 3.

Referring back to FIG. 3, the sport helmet 10 includes an occipital inner pad 240 being at least partially located in the rear space 238 for facing the occipital region OR (FIG. 1) of the wearer's head. More particularly, and as shown in FIGS. 17-18, the occipital inner pad 240 is located in the rear space 238 defined by the left, central and right walls 232, 234, 236 of the rear padding portion 230.

The occipital inner pad 240 may be made of expanded polypropylene (EPP) or expanded polyethylene (EPE) or polypropylene foam or polyethylene foam having two different densities. Other materials such as polyvinyl chloride (PVC) foam, polyurethane foam or any other suitable materials can be used for the occipital inner pad 240.

Referring to FIGS. 17 to 24, the occipital inner pad 240 has a first part 242 extending along an axis generally parallel to the vertical axis VA and a second part 244 extending along an axis generally parallel to the transversal axis TA, the first part 242 comprising an upper end 246 hingedly connected to the central wall 234 of the rear padding portion 230 and a bottom end 248 connected to the second part 244. The first and second parts 242, 244 define herein an inverted T-shape. The second part 244 has a front side 250 for contacting the occipital region OR of the wearer's head and a rear side 252 for facing the inner wall 224 of the rear shell 216. It is understood that the first and second parts 242, 244 may be separate parts connected together.

It is understood that the upper end 246 of the occipital inner pad 240 may be hingedly connected to the inner wall 224 of the rear shell portion 16 instead to the rear padding portion 230.

As best shown in FIGS. 23 to 26, a gap 254 is defined between the rear side 252 of the occipital pad 240 and the inner wall 224 of the rear shell 216. The sport helmet 10 further comprises a two biasing portions, namely a left biasing portion 256 and a right biasing portion 264 that are both located between the inner wall 224 of the rear shell portion 16 and the occipital inner pad 240 and that is in the gap 254. It will be appreciated that only one or more than two biasing portions may alternatively be used.

Figure 24:
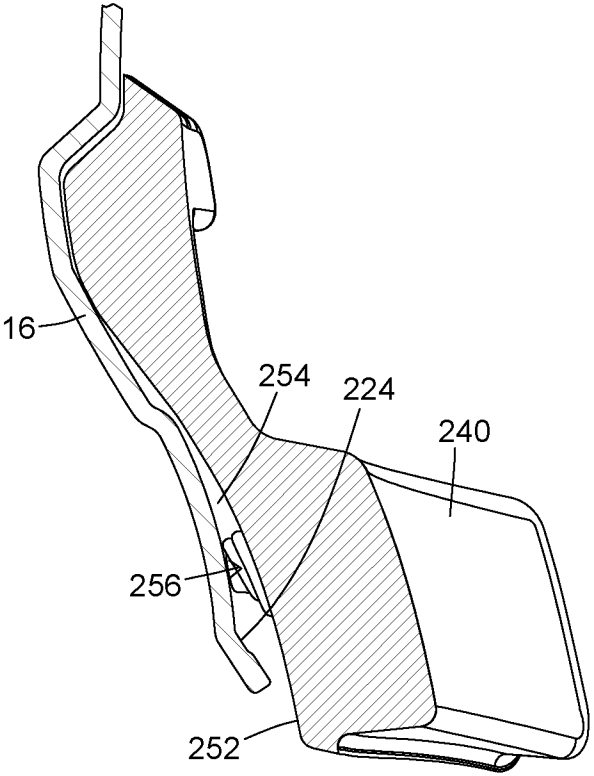
FIG. 24 is a schematic partial enlarged cross-sectional view of the rear shell portion and the occipital inner pad with the biasing portions, wherein the occipital inner pad is shown in a second position.
Figure 23:
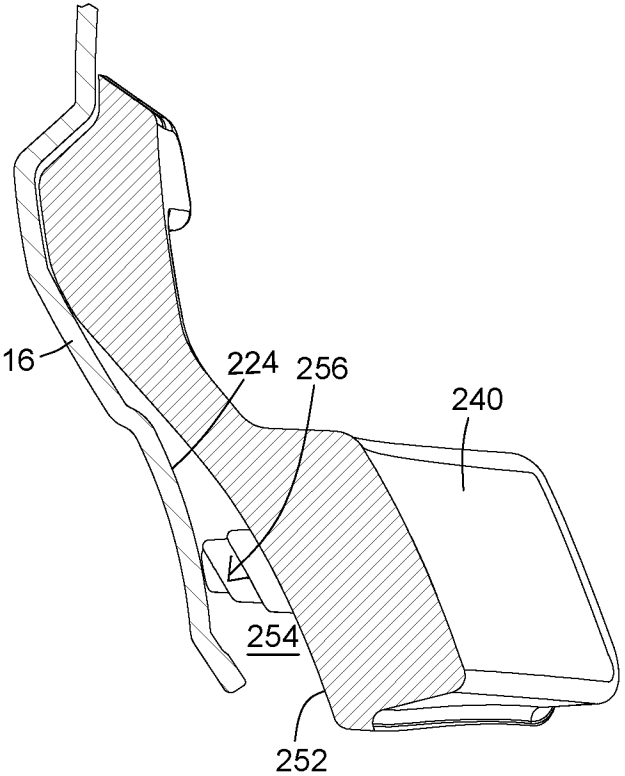
FIG. 23 is a schematic partial enlarged cross-sectional view of the rear shell portion and the occipital inner pad with the biasing portions, wherein the occipital inner pad is shown in a first position.
Figure 26:
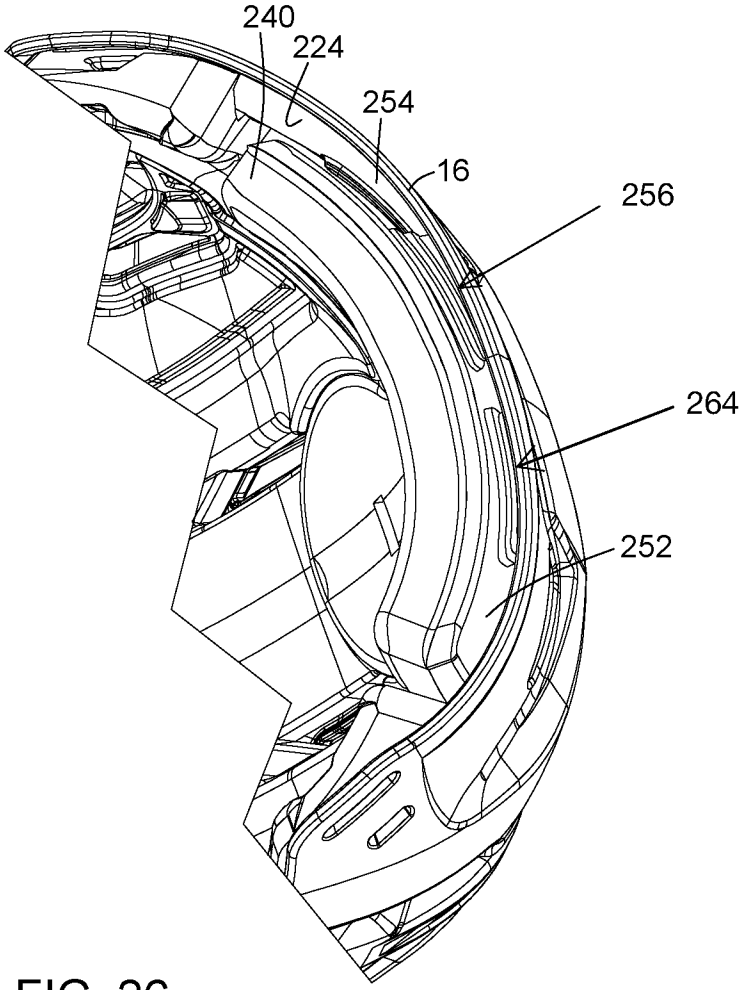
FIG. 26 is a schematic partial bottom three dimensional view of the helmet of FIG. 3 wherein the occipital inner pad is shown in the second position.
Figure 25:
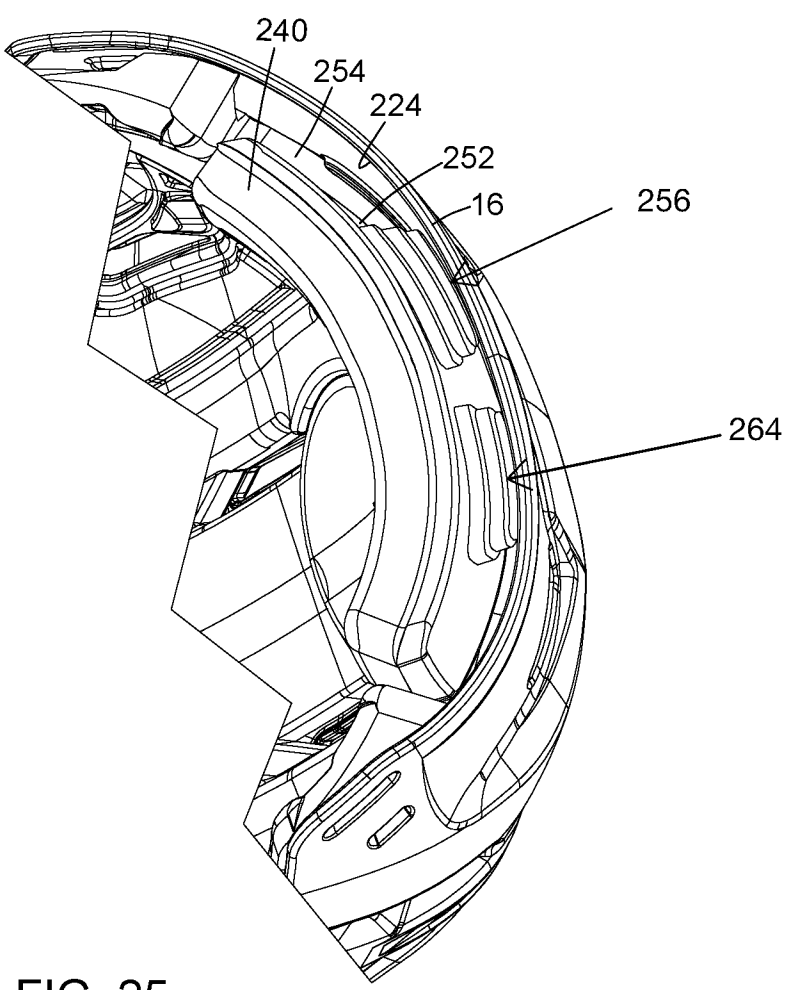
FIG. 25 is a schematic partial bottom three dimensional view of the helmet of FIG. 3 wherein the occipital inner pad is shown in the first position.

In use, the occipital inner pad 240 is movable between a first position, wherein the occipital inner pad 240 is biased inwardly by the biasing portion 256 (see FIGS. 23 and 25), and, when the wearer puts on the helmet, a second position wherein the occipital inner pad 240 is moved towards the inner wall 224 of the rear shell portion 16 and wherein the biasing portions 256, 264 exerts pressure on the occipital inner pad 240 such that the occipital inner pad 240 contacts the occipital region OR of the wearer's head while maintaining pressure against the occipital region OR of the wearer's head (see FIGS. 24 and 26).

In one variant, the biasing portions 256, 264 are mounted on the occipital inner pad 240 and extends rearwardly from the occipital inner pad 240 such that the biasing portions 256, 264 occupy the gap 254.

Figure 22:
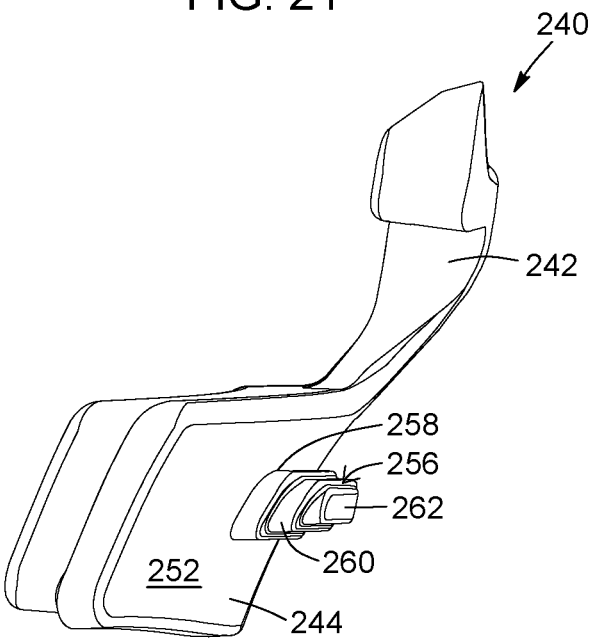
FIG. 22 is a schematic side enlarged view of the occipital inner pad with the biasing portions mounted thereto.

Referring more particularly to FIG. 22, the left biasing portion 256 comprises a base portion 258 located adjacent the occipital inner pad 240, a middle portion 260 and an end portion 262 that is away from the base portion 258 and that is adapted to face the inner wall 224 of the rear shell portion 216.

In one variant, the right biasing portion 264 is mounted on the occipital inner pad 240 and extends rearwardly from the occipital inner pad 240 such that the biasing portion 264 occupies the gap 254.

Figure 19:
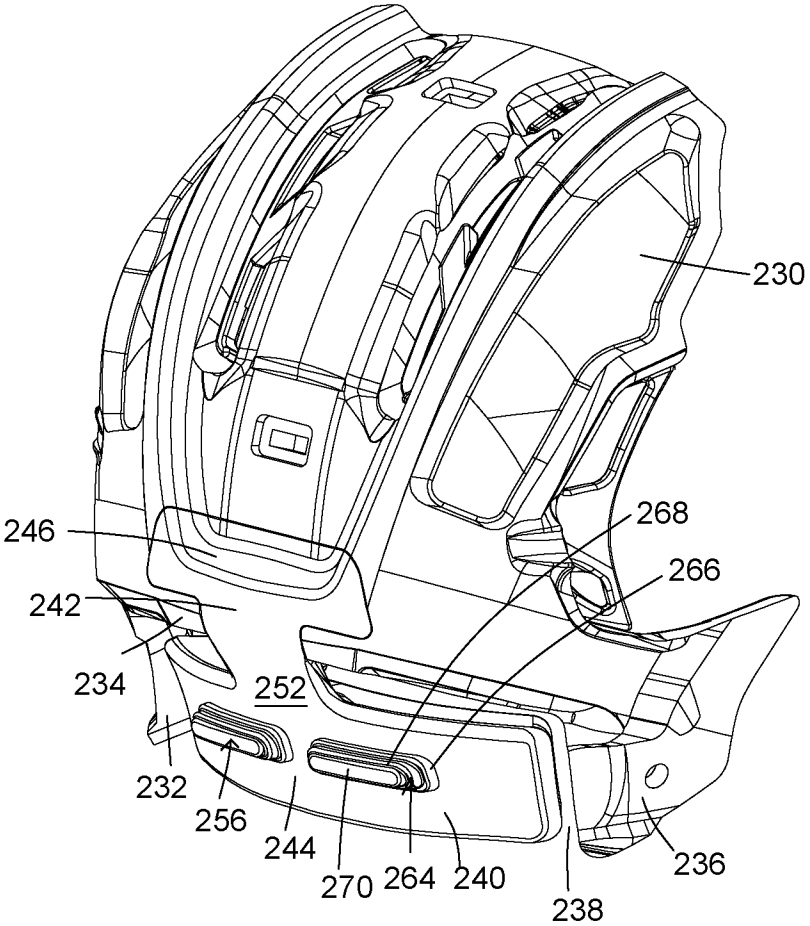
FIG. 19 is a schematic rear perspective view showing the occipital inner pad with the biasing portions wherein the occipital inner pad is mounted to the rear padding portion of the sport helmet of FIG. 3.
Figure 20:
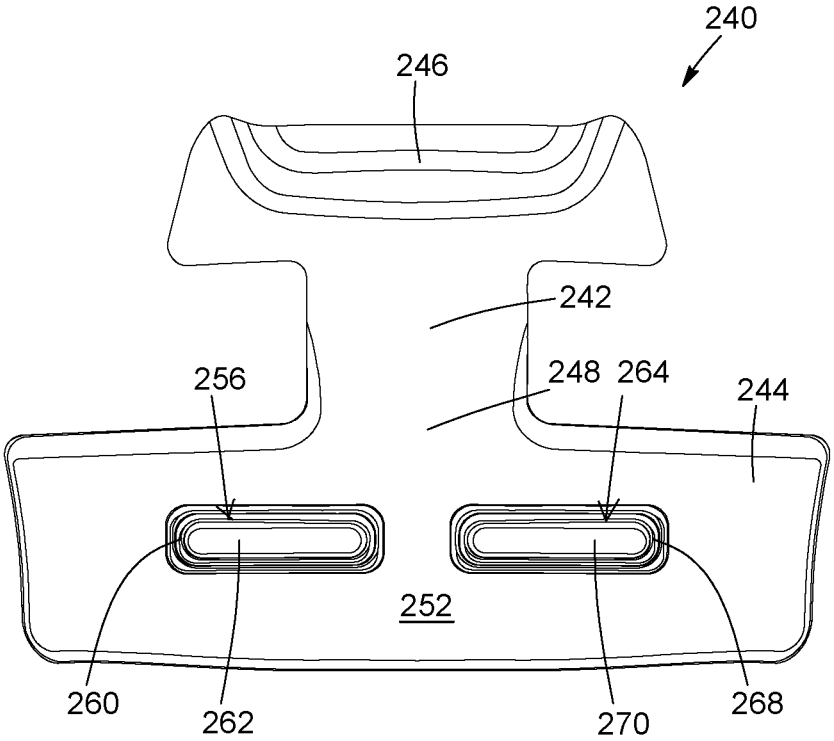
FIG. 20 is a schematic rear enlarged view of the occipital inner pad with the biasing portions mounted thereto.
Figure 21:
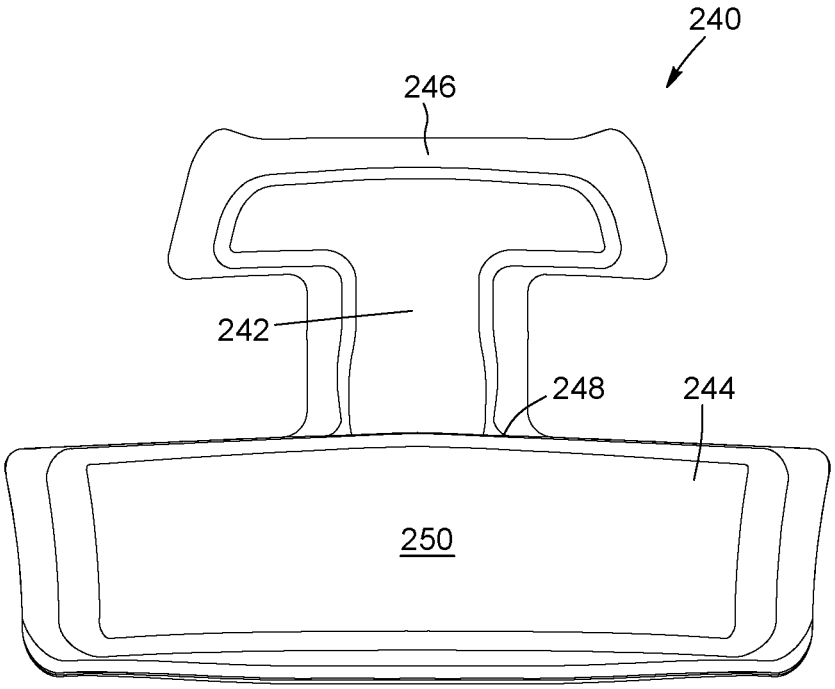
FIG. 21 is a schematic front enlarged view of the occipital inner pad.

Similarly to the left biasing portion 256, and as shown on FIG. 19, the right biasing portion 264 comprise a base portion 266 located adjacent the occipital inner pad 240, a middle portion 268 and an end portion 270 that is away from the base portion 266 and that is adapted to face the inner wall 224 of the rear shell portion 16.

Each of the middle portions 260, 268 of the biasing portions 256, 264 may have an oblong or rounded shape or may have four walls defining a parallelogram, a trapezium, a rhombus, a kite, a rectangle or a square. In one variant, the body may define a truncated trapezoidal pyramid.

Each of the middle portions 260, 268 of the biasing portions 256, 264 may comprise a plurality of sections superposed onto each other between the base portions 258, 266 and the end portions 262, 270, the plurality of sections including a first section located adjacent the base portions 258, 266 and a second section located adjacent the end portions 262, 270, the first section having a first cross-sectional area and the second section having a second cross-sectional area smaller than the first cross-section area. In one variant, the first section has a first thickness and the second section has a second thickness smaller than the first thickness.

The plurality of sections may comprise at least one intermediate section located between the first section and the second section, the intermediate section having a third cross-sectional area smaller than the first cross-section area of the first section and greater than the second cross-sectional area of the second section. In one variant, the at least one intermediate section is a single intermediate section between the first and second sections.

Each of the left and right biasing portions 256, 264 may be made of a resilient material such that the occipital inner pad 240 returns to the first position (FIG. 16) when pressure is no longer applied on the occipital inner pad 240 and such that each of the biasing portions 256, 264 is compressed and exerts pressure on the occipital inner pad 240 in the second position (FIG. 17). In the first position, the end portions 262, 270 of each of the left and right biasing portions 256, 264 may abut the inner wall 224 of the rear shell portion 16 for biasing the occipital inner pad 240 inwardly, and in the second position, the end portions 262, 270 of each of the left and right biasing portions 256, 264 may abut the inner wall 224 of the rear shell portion 16 while each of the biasing portions is compressed and exerts pressure on the occipital inner pad 240.

Each of the left and right biasing portions 256, 264 may be made of a resilient material such as an elastomeric material (e.g., a rubber such as styrene-butadiene rubber or any other suitable rubber), a polyurethane elastomer such as thermoplastic polyurethane (TPU), any other thermoplastic elastomer. The biasing portions 256, 264 may be made of expanded polypropylene, expanded polyurethane, expanded polystyrene, ethyl vinyl acetate (EVA), polyethylene (PE), vinyl nytril (VN), silicone, or any other suitable material that has the ability to return to its original shape when pressure is no longer applied to it. As indicated previously, terms such as "mounted", "connected", "supported" and "coupled" and variations thereof are used broadly and encompass both direct and indirect mountings, connections, supports and couplings. For instance, each of the left and right biasing portions 256, 264 may be affixed on the rear side 252 of the occipital inner pad 240, may be overmolded onto the occipital inner pad 240, may be inserted in left and right apertures of the occipital inner pad 240 wherein each of the left and right biasing portions 256, 264 extends rearwardly from the occipital inner pad 240 such that the biasing portion occupies the gap 254, or may be integrally formed with the occipital inner pad 240 such that the left and right biasing portions 256, 264 are integrated parts of the occipital inner pad 240, etc.

It is also understood that each of the left and right biasing portions 256, 264 may be made of a material that is the same of the material of the occipital inner pad 240 or may be made of a material different than the material of the occipital inner pad 240. In addition, each of the left and right biasing portions 256, 264 may be made of a material having first characteristics (e.g. density or resilience) and the occipital inner pad 240 may be made of a material having second characteristics (e.g. density or resilience), the first characteristics being different than the second characteristics.

It is further understood that the left and right biasing portions 256, 264 may be replaced by a single biasing portion that extends along a sufficient length along an axis generally parallel to the traversal axis TA such that the single biasing portion occupies a sufficient space of the gap 254 wherein the occipital inner pad is biased inwardly by the single biasing portion in the first position and wherein the single biasing portion exerts pressure on the occipital inner pad 240 such that the occipital inner pad 240 contacts the occipital region OR of the wearer's head while maintaining pressure against the occipital region OR of the wearer's head in the second position.

It is also understood that the left and right biasing portion 256, 264 may be replaced by three or more biasing portions.

As indicated previously, the left biasing portion 256 and/or the right biasing portion 264 are between the inner wall 224 of the rear shell portion 16 and the occipital inner pad 240 such that the occupy the gap 254. In one variant, the biasing portion may be mounted to the occipital inner pad 240. It is understood that the biasing member may be mounted to the inner wall 224 of the rear shell portion 16 instead to the occipital inner pad 240 as long as the biasing member occupies the gap 254 and as long it is adapted to bias inwardly the occipital inner pad in the first position and is adapted to exert pressure on the occipital inner pad 240 such that the occipital inner pad 240 contacts the occipital region OR of the wearer's head while maintaining pressure against the occipital region OR of the wearer's head in the second position.

Figure 27:
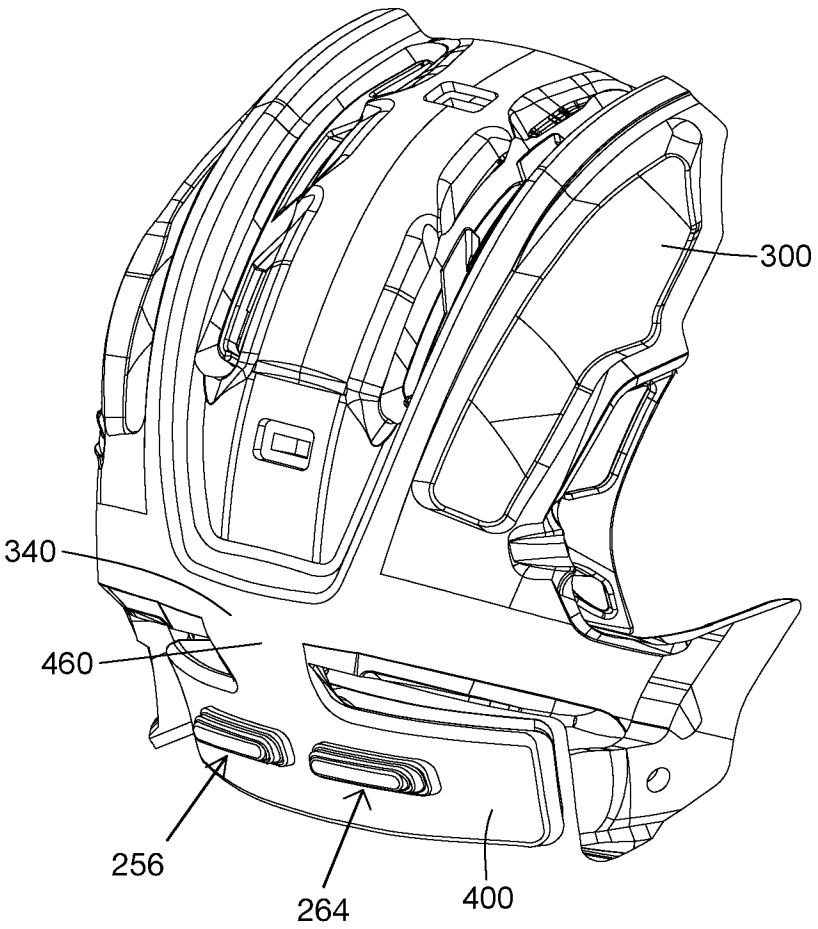
FIG. 27 shows a variant of the occipital inner pad wherein the occipital inner pad is monolithically connected to the rear padding portion of the sport helmet.

Referring to FIG. 27, the helmet in accordance with another embodiment may comprise a rear padding portion 300 wherein an upper end 460 of the occipital inner pad 400 is monolithically connected to a central wall 340 of the rear padding portion 300 such that the occipital inner pad 400 is integrally formed with the rear padding portion 300.

Method of Making an Inner Pad

The steps described above may be used to manufacture any padding portions of the helmet 10. For instance, and with reference to FIGS. 4-5, the steps below may be used to manufacture the front padding portion 94, the left padding portion 96, the right padding portion 98, the rear padding portion 100 and/or the occipital inner pad 240. The steps below are used for manufacturing the left padding portion 96 but may be applied for any other padding portion.

Figure 28:
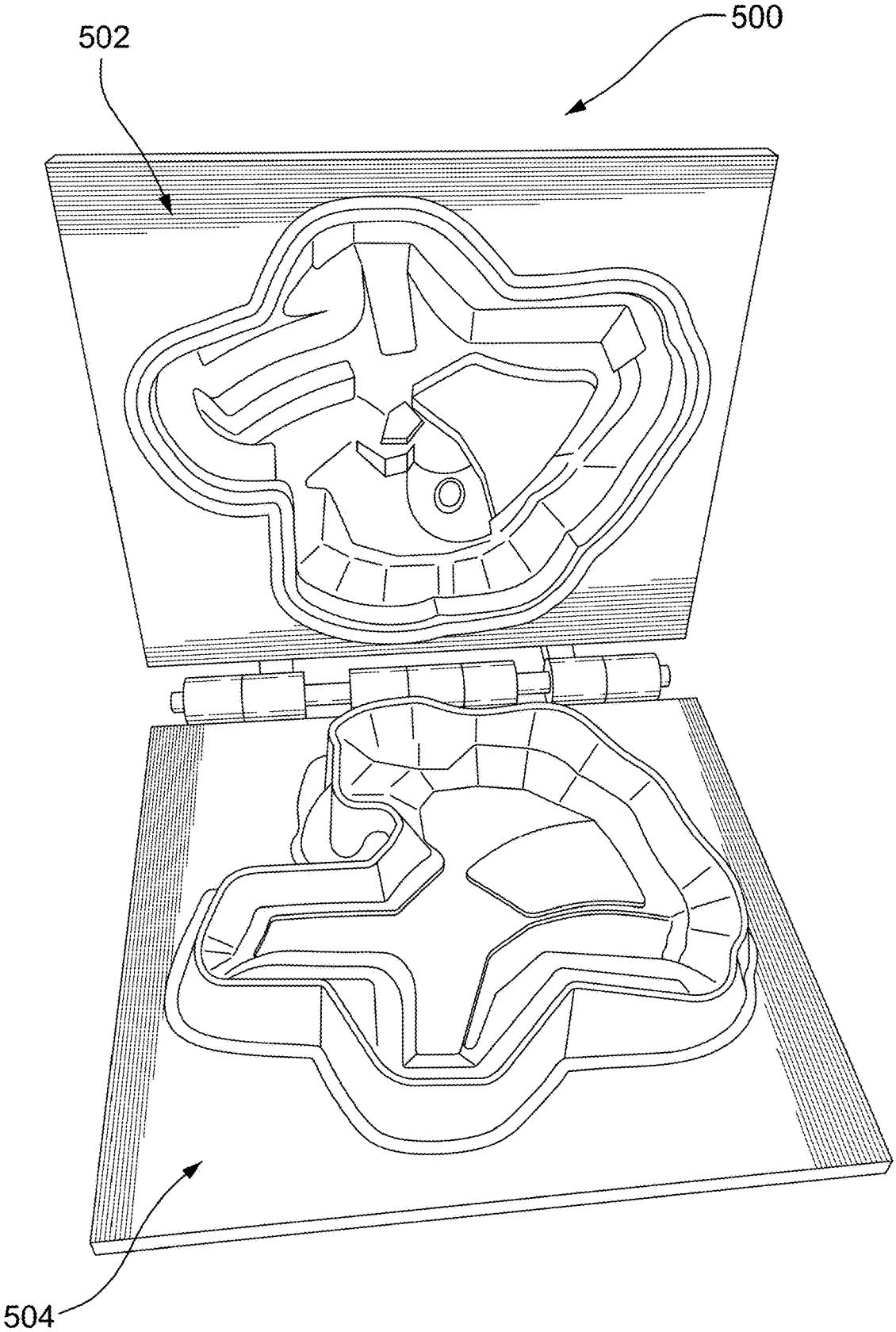
FIG. 28 is a schematic three dimensional view of a mold used for manufacturing a left padding portion of the inner padding of the helmet of FIG. 3.
Figure 29:
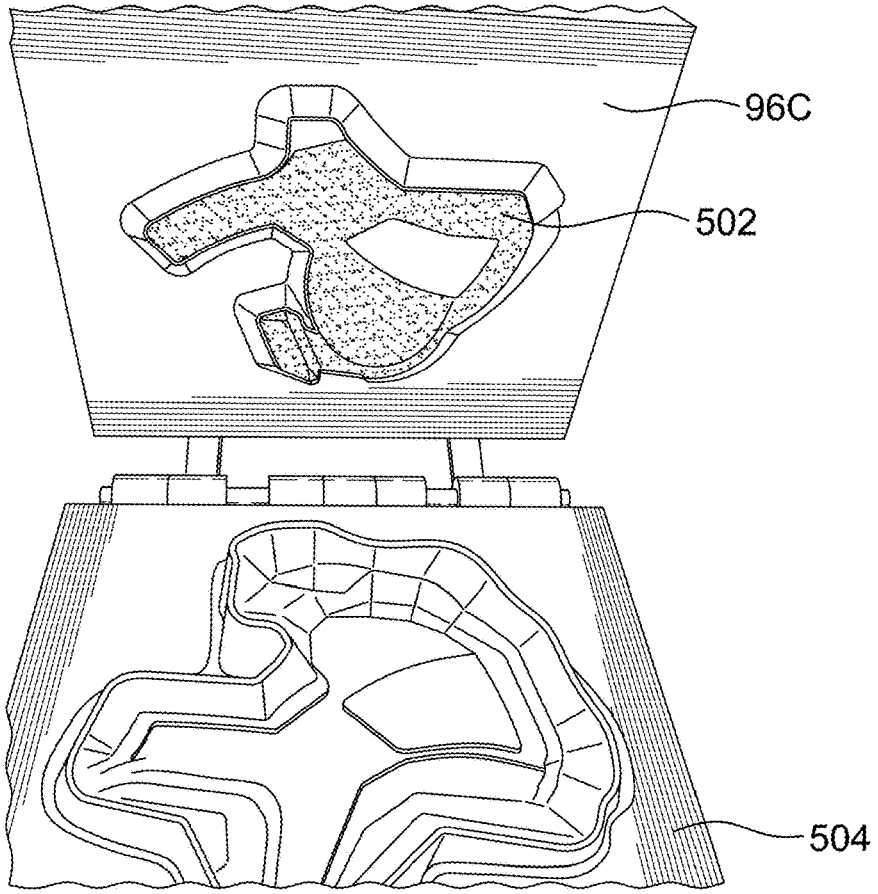
FIG. 29 is a schematic three dimensional view of a mold used for manufacturing the left padding portion of the inner padding of the helmet of FIG. 3 with a core of said padding mounted to the mold.
Figure 30:
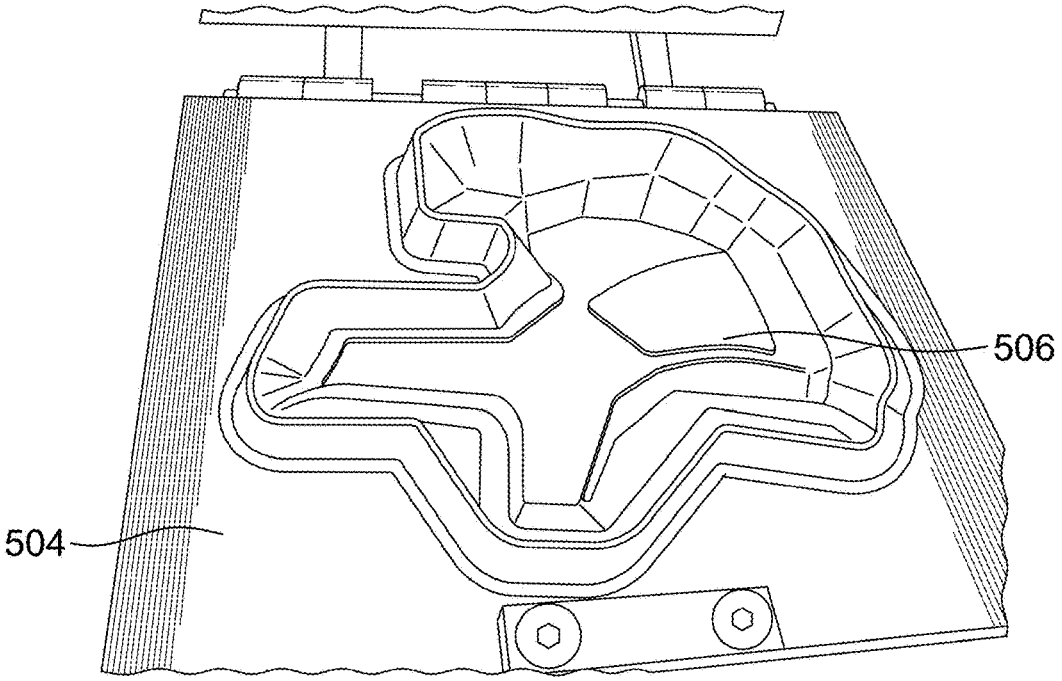
FIG. 30 is a schematic three dimensional view of a bottom part of the mold of FIG. 28 used for manufacturing the left padding portion of the inner padding of the helmet of FIG. 3, a sheet of a material laid on said bottom part of the mold.

Referring to FIGS. 28-30, a core 96C of a material, which may be expanded polypropylene (EPP) is made with a suitable three-dimensional shape. Edge portion of the core 96C are sanded such that the edge portion is able to receive an over molded material. A hand sander may be used to grind off the surface of the core. In a particular embodiment, at most 1 mm of material is removed while sanding the edge portion. The core 96C is placed in a first part 502 of a two-part mold 500 and a sheet 506 of a second material, such as thermoplastic polyurethane (TPU) is placed in a second part 504 of the two-part mold 500. Vacuum may be applied to the sheet 506 such that the sheet better conforms with a cavity C of the second part 504 of the two-part mold 500. A third material, such as a PU material, is injected in to the two-part mold 500. In a particular embodiment, the temperature of the mold 500 is kept at about 50 degrees Celsius. Then, the two-part mold 500 is fastened such that it is completely closed. The two-part mold 500 containing the different materials is left to rest for a given time duration, which may be about 15 minutes, until the material foams. The mold temperature may be about 50 degrees Celsius during the foaming process. The two-part mold 500 is then open and the product is extracted from the two-part mold 500. An inspection may be carried and excess material may be trimmed off.

In one variant, the hardness of the comfort foam (TPU covering) ranges from 30 to 45 Shore 00 and the hardness of the performance liner (EPP core) ranges from 80 to 85 Shore 00.

Padding Portions With Two Materials

Referring back to FIGS. 4-5, the front portion 94 of the inner padding 18 may be made of a first material whereas the rear portion 100 of the inner padding may be made of a second material different than the first material.

In one variant, the front inner pad 94 may be at least partially made of the first material and the rear inner pad 100 may be at least partially made of the second material. The second material may be a film or a coating that at least partially covers the rear inner pad 100. In one example, the front inner pad 94 may be made of the first material and the rear inner pad 100 may be made of the first material, which is at least partially covered with a film or a coating made of the second material.

The first material of the inner padding may be at least partially made of ethylene vinyl acetate (EVA) foam, a vinyl nitrile (VN) foam, a polyvinyl chloride (PVC) foam, neoprene, silicone, Lycra, spandex or rubber. The second material may be at least partially made of thermoplastic polyurethane, polyethylene, vinyl, Teflon, polystyrene or polypropylene.

The first material has a first coefficient of friction and the second material has a second coefficient of friction, the first coefficient of friction being higher than the second coefficient of friction.

The coefficient of friction may be characterized by the ASTM G115-10 Standard Guide for Measuring and Reporting Friction Coefficients. The first coefficient of friction of the first material may be from about 0.50 to about 0.75 and the second coefficient of friction of the second material may be from about 0.20 to about 0.45. Herein, "about" implies a variation of plus or minus 10% of the value. For example, about 10 implies from 9 to 11.

According to a second embodiment, the sport helmet comprises an inner liner mounted within the inner padding for covering at least partially the wearer's head. The inner liner comprises a front portion for at least partially covering the front and top regions of the wearer's head and a rear portion for at least partially covering the rear region of the wearer's head. The front portion is at least partially made of a first material and the rear portion is at least partially made of a second material, the first material being different than the second material.

The second material may be a film or a coating that at least partially covers the rear portion of the inner liner. In one example, the front portion of the inner liner may be made of the first material and the rear portion of the inner liner may be made of the first material, which is at least partially covered with a film or a coating made of a second material, the second material having a lower coefficient of friction than the one of the first material.

The first material of the inner liner may be at least partially made of ethylene vinyl acetate (EVA) foam, a vinyl nitrile (VN) foam, a polyvinyl chloride (PVC) foam, neoprene, silicone, Lycra, spandex or rubber. The second material may be at least partially made of thermoplastic polyurethane, polyethylene, vinyl, Teflon, polystyrene or polypropylene.

The first material has a first coefficient of friction and the second material has a second coefficient of friction, the first coefficient of friction being higher than the second coefficient of friction. The coefficient of friction may be characterized by the ASTM G115-10 Standard Guide for Measuring and Reporting Friction Coefficients. The first coefficient of friction of the first material may be from about 0.50 to about 0.75 and the second coefficient of friction of the second material may be from about 0.20 to about 0.45.

It is understood that the first material has a higher coefficient of friction such that the front portion of the inner padding or of the inner liner generates more resistance to internal movements relative to the wearer's head when, for instance, the helmet is moved upon an impact against the outer shell. It is also understood that the second material has a lower coefficient of friction such that the rear portion of the inner padding or of the inner liner generates less resistance to internal movements relative to the wearer's head when, for instance, the helmet is moved upon an impact against the outer shell.

It is also understood that the first material may provide, may promote or may increase frictional engagement with the wearer's head while the second material may provide, promote or increase sliding engagement with the wearer's head.

The frictional engagement between the front portion of the inner padding or of the inner liner and the wearer's head may work in conjunction with other mechanisms or features of the helmet to absorb and reduce the rotational acceleration of the wearer's head as a result of an impact against the outer shell 12. More particularly, the presence of friction at the interface between the inner surface of the front portion of the inner padding or of the inner liner and the wearer's head may contribute to dissipate energy during rotational movement by generating heat.

Alternatively, or in addition, the sliding engagement between the rear portion of the inner padding or of the inner liner and the wearer's head may work in conjunction with other mechanisms or features of the helmet to absorb and reduce the rotational acceleration of the wearer's head as a result of an impact against the outer shell 12. More particularly, the sliding engagement at the interface between the inner surface of the rear portion of the inner padding or of the inner liner and the wearer's head may allow a suitable amount of rotation of the sport helmet around the wearer's head while other part or parts of the helmet absorb the rotational acceleration by compression and/or shearing movement.

Moreover, the frictional engagement between the front portion of the inner padding or of the inner liner and the wearer's head may increase the fit or comfort of the helmet with respect to the wearer's head. More particularly, the presence of friction at the interface between the inner surface of the front portion of the inner padding or of the inner liner and the front and top regions of the wearer's head may provide a better fit or better comfort (for the regions where hairs may not be or be less present and where the skin may be in direct contact with the padding or liner).

Alternatively, or in addition, the sliding engagement between the rear portion of the inner padding or of the inner liner and the wearer's head may increase the fit or comfort of the helmet with respect to the wearer's head. More particularly, the sliding engagement at the interface between the inner surface of the rear portion of the inner padding or of the inner liner and the rear region of the wearer's head may provide a better fit or better comfort (for the regions where hairs are present and the where skin may not be in direct contact with the padding or liner).

Any variants, examples or preferred embodiments of the present disclosure are explained in detail herein above. It is to be understood that the present disclosure is not limited in its application to the details of construction and the arrangement of components set forth in the following description or illustrated in the drawings. The present disclosure is capable of other variants or embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional suitable items. Unless specified or limited otherwise, the terms "mounted", "connected", "supported" and "coupled" and variations thereof are used broadly and encompass both direct and indirect mountings, connections, supports and couplings and are thus intended to include direct connections between two members without any other members interposed therebetween and indirect connections between members in which one or more other members are interposed therebetween. Further, "connected" and "coupled" are not restricted to physical or mechanical connections or couplings. Additionally, the words "lower", "upper", "upward", "down", "toward" and "downward" designate directions in the drawings to which reference is made. Similarly, the words "left", "right", "front" and "rear" designate locations or positions in the drawings to which reference is made. The terminology includes the words specifically mentioned above, derivatives thereof, and words or similar import.

The above description of the variants, examples or embodiments should not be interpreted in a limiting manner since other variations, modifications and refinements are possible within the scope of the present disclosure. Accordingly, it should be understood that various features and aspects of the disclosed variants or embodiments can be combined with or substituted for one another in order to form varying modes of the present disclosure. For example, and without limitation, any individual element(s) of the described variants or embodiments may be replaced by alternative elements that provide substantially similar functionality or otherwise provide adequate operation. This includes, for example, presently known alternative elements, such as those that might be currently known to a skilled person in the art, and alternative elements that may be developed in the future, such as those that a skilled person in the art might, upon development, recognize as an alternative. Further, the disclosed variants or embodiments include a plurality of features that are described in concert and that might cooperatively provide a collection of benefits. The present disclosure is not limited to only those embodiments that include all of these features or that provide all of the stated benefits, except to the extent otherwise expressly set forth in the issued claims. Any reference to claim elements in the singular, for example, using the articles "a", "an", or "the", is not to be construed as limiting the element to the singular. Any reference to claim elements as "at least one of X, Y and Z" is meant to include any one of X, Y or Z individually, and any combination of X, Y and Z, including, X, Y, Z; X, Y; X, Z; and Y, Z. The scope of the disclosure is defined in the appended claims and their equivalents.

What is claimed is:

1. A sport helmet for receiving a head of a wearer, comprising:

an outer shell;

an inner padding mounted within the outer shell for covering at least partially the wearer's head, the inner padding defining a base face configured to be oriented toward the wearer's head and at least one pedestal extending from the base face away from the outer shell, the at least one pedestal defining a pedestal face configured for facing the wearer's head, the at least one pedestal face being offset from the base face along a direction normal to the base face, the base face surrounding the at least one pedestal face; and at least one tangential shock absorber having a first face at least partially covering the pedestal face and a second face opposed the first face and configured for contacting the wearer's head, the at least one tangential shock absorber including a shearable member, the shearable member deformable such that the first face is movable relative to the second face in a direction having a radial component relative to an axis normal to the pedestal face.

2. The sport helmet of claim 1, wherein the at least one tangential shock absorber is a bladder and wherein the shearable member is at least one fluid.

3. The sport helmet of claim 1, wherein the shearable member includes a first layer of a first fluid and a second layer of a second fluid, the first layer sandwiched between the at least one pedestal and the second layer, the first fluid having a viscosity different than that of the second fluid.

4. The sport helmet of claim 1, wherein the at least one tangential shock absorber is secured to the at least one pedestal by a rivet, the rivet having a male member secured to one of the at least one pedestal and the at least one tangential shock absorber and a female member removably engageable by the male member and secured to the other of the at least one pedestals and the at least one tangential shock absorber.

5. The sport helmet of claim 4, wherein the rivet is made of shock absorbing material.

6. The sport helmet of claim 1, wherein the at least one pedestal includes a front pedestal configured to be located to face a front portion of the wearer's head, a rear pedestal configured to be located to face a rear portion of the wearer's head, left and right pedestals each configured for facing a respective one of left and right sides of the wearer's head, and a top pedestal configured to face a top portion of the wearer's head.

7. The sport helmet of claim 6, wherein the at least one tangential shock absorber includes front, rear, left, right, and top tangential shock absorbers each secured to a respective one of the front, rear, left right, and top pedestals.

8. The sport helmet of claim 1, wherein a distance between the pedestal face and the base face taken along the axis normal to the pedestal face ranges from 0.5 mm to 5 mm.

9. The sport helmet of claim 1, wherein an area of the pedestal face is less than that of the first face.

10. The sport helmet of claim 1, wherein the at least one pedestal is made from one or more of: expanded polypropylene foam; expanded polyethylene foam; vinyl nitrile foam; and expanded polymeric foam.

11. The sport helmet of claim 1, wherein a material of the at least one pedestal is different than a material of a remainder of the inner padding.

12. The sport helmet of claim 1, wherein a material of the at least one pedestal corresponds to a material of a remainder base of the inner padding.

13. The sport helmet of claim 1, wherein the at least one pedestal is monolithic with a remainder of the inner padding.

14. The sport helmet of claim 1, wherein the inner padding is made of rubber, styrene-butadiene rubber, polyurethane elastomer, polyvinyl chloride foam, or polyurethane foam.

15. A sport helmet for receiving a head of a wearer, comprising: an outer shell; and an impact-mitigating system at least partially enclosed by the outer shell and defining a head interface for contacting the wearer's head, the impact-mitigating system including a rotational-impact-mitigation layer extending from the head interface toward the outer shell, a linear-impact-mitigation layer extending from the outer shell toward the head interface, and an intermediate layer between the rotational-impact-mitigation layer and the linear-impact-mitigation layer, the linear-impact-mitigation layer including an inner padding, the intermediate layer having at least one pedestal affixed relative to the inner padding, the rotational-impact-mitigation layer having at least one shearable member at least partially covering the at least one pedestal, the at least one shearable member spaced apart from the inner padding by the at least one pedestal, the at least one pedestal having a pedestal face being offset from the inner padding along a direction normal to the inner padding, the inner padding surrounding the at least one pedestal face, the at least one shearable member having a first face and a second face opposite the first face and facing the pedestal, the first face defining a part of the head interface and being translatable relative to the second face and relative to the pedestal in a direction being at least partially tangential to the head interface.

16. The sport helmet of claim 15, wherein the at least one shearable member is a bladder containing at least one fluid.

17. The sport helmet of claim 15, wherein the at least one shearable member includes a first layer of a first fluid and a second layer of a second fluid, the first layer sandwiched between the at least one pedestal and the second layer, the first fluid having a viscosity different than that of the second fluid.

18. The sport helmet of claim 15, wherein the at least one shearable member is secured to the at least one pedestal by a rivet, the rivet having a male member secured to one of the at least one pedestal and the at least one tangential shock absorber and a female member removably engageable by the male member and secured to the other of the at least one pedestals and the at least one tangential shock absorber.

19. The sport helmet of claim 15, wherein the at least one pedestal includes a front pedestal located to face a front portion of the wearer's head, a rear pedestal located to face a rear portion of the wearer's head, left and right pedestals each facing a respective one of left and right sides of the wearer's head, and a top pedestal to face a top portion of the wearer's head.

20. The sport helmet of claim 19, wherein the at least one shearable member includes front, rear, left, right, and top shearable members each secured to a respective one of the front, rear, left right, and top pedestals.

21. The sport helmet of claim 15, wherein a distance between the linear-impact-mitigation layer and the rotational-impact-mitigation layer ranges from 0.5 to 5 mm.

22. A sport helmet for receiving a head of a wearer, comprising: an outer shell; an inner padding in the outer shell, the inner padding having a rear padding portion for covering at least part of a rear region of the wearer's head, the rear padding portion comprising left, central and right walls defining a rear space for at least partially overlapping an occipital region of the wearer's head; an occipital inner pad being at least partially located in the rear space for facing the occipital region of the wearer's head; and at least one biasing portion between the outer shell and the occipital inner pad, the occipital inner pad movable between a first position and a second position, wherein in the first position the occipital inner pad is biased inwardly by the at least one biasing portion, and wherein in the second position the occipital inner pad is moved towards the outer shell upon the sport helmet covering the wearer's head, the at least one biasing portion configured for biasing the occipital inner pad against the wearer's head such that the occipital inner pad is configured to contact the wearer's head while being configured for maintaining pressure against the occipital region of the wearer's head, the occipital inner pad being in the first position while the sport helmet is not worn and being in the second position when the sport helmet receives the head of the wearer.

23. The sport helmet of claim 22, wherein the at least one biasing portion is made of a resilient material such that the occipital inner pad returns to the first position when the occipital inner pad is free of pressure applied thereto and such that the at least one biasing portion is compressed and exerts pressure on the occipital inner pad in the second position.

24. The sport helmet according to claim 22, wherein the at least one biasing portion defines an end portion for facing the outer shell, the end portion in abutment against the outer shell in both of the first and second positions.

25. The sport helmet according to claim 22, wherein the at least one biasing portion includes a left biasing portion located on a left side of the helmet and a right biasing portion located on a right side of the helmet.

26. The sport helmet according to claim 22, wherein the at least one biasing portion comprises a base portion located adjacent to the occipital inner pad, an end portion spaced apart from the base portion, the at least one biasing portions tapering from the base portion to the end portion.

27. The sport helmet according to claim 22, wherein the at least one biasing portion comprises a base portion located adjacent to the occipital inner pad and away from an end portion and a plurality of sections superposed onto each other between the base portion and the end portion, the plurality of sections including a first section located adjacent the base portion and a second section located adjacent the end portion, the first section having a first cross-sectional area and the second section having a second cross-sectional area smaller than the first cross-section area.

28. The sport helmet according to claim 27, wherein the plurality of sections includes at least one intermediate section located between the first section and the second section, each intermediate section having a third cross-sectional area smaller than the first cross-section area and greater than the second cross-sectional area.

29. The sport helmet according to claim 22, wherein the occipital inner pad has a first part downwardly from the central wall and a second part extending transversally from the first part, the first part comprising an upper end hingedly connected to the central wall of the rear padding portion or to the inner wall of the rear shell portion and a bottom end connected to the second part.

30. The sport helmet according to claim 29, wherein the upper end of the first part of the occipital inner pad is monolithically connected to the central wall of the rear padding portion.

31. A sport helmet for receiving a head of a wearer, the wearer's head having a front region, a top region, left and right side regions and a rear region, the helmet comprising an outer shell and an inner padding mounted within the outer shell for covering at least partially the wearer's head, the inner padding comprising a front portion for covering at least partially the front and top regions of the wearer's head and a rear portion for covering at least partially the rear region of the wearer's head, the front portion being at least partially made of a first material and the rear portion being at least partially made of a second material, the first material being different than the second material, wherein at least one tangential shock absorber is mounted to the inner padding, the at least one tangential shock absorber having a padding-contacting face facing the inner padding and a head-contacting face opposed the padding-contacting face and configured for contacting the wearer's head, the at least one tangential shock absorber including a shearable member, the shearable member deformable such that the padding-contacting face is movable relative to the head-contacting face in a direction having a radial component relative to an axis normal to the inner padding.

* * * * *